US010631711B2

(12) United States Patent
Dunn et al.

(10) Patent No.: US 10,631,711 B2
(45) Date of Patent: Apr. 28, 2020

(54) MODULAR BOTTLE RACK

(71) Applicant: MUNCHKIN, INC., Van Nuys, CA (US)

(72) Inventors: Steven Bryan Dunn, Beverly Hills, CA (US); Mark A. Hatherill, Beverly Hills, CA (US); Yong Sun Simon Kang, Pasadena, CA (US); Mark Gerard Tebbe, Ventura, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/439,756

(22) Filed: Feb. 22, 2017

(65) Prior Publication Data

US 2017/0245730 A1 Aug. 31, 2017

Related U.S. Application Data

(60) Provisional application No. 62/300,053, filed on Feb. 25, 2016.

(51) Int. Cl.
*A47L 19/02* (2006.01)

(52) U.S. Cl.
CPC ..... *A47L 19/02* (2013.01)

(58) Field of Classification Search
CPC ..... A47L 19/02; A47L 19/04; A47L 15/505; A47L 15/503; A47L 15/501; A47L 15/50; A47L 15/502; F26B 25/18
USPC ..... 211/41.1–41.9
See application file for complete search history.

(56) References Cited

U.S. PATENT DOCUMENTS 3,146,815 A * 9/1964 Cirese ..... A47J 47/005 269/302
4,137,596 A * 2/1979 Carlson ..... A46B 7/026 15/203
4,606,464 A * 8/1986 Jordan ..... A47L 15/503 211/184
5,109,990 A * 5/1992 Murphy ..... A47J 47/20 211/41.3
5,480,035 A * 1/1996 Smith ..... A47L 15/503 211/168
5,492,237 A * 2/1996 Chang ..... A47L 19/04 211/118
6,038,784 A * 3/2000 Dunn ..... A47L 19/04 211/41.6
6,125,548 A 10/2000 Dunn et al.
6,364,130 B2 * 4/2002 Wright ..... A47L 19/04 211/184

(Continued)

OTHER PUBLICATIONS

International Search Report and Written Opinion for PCT/US2017/019218, International Filing Date Feb. 23, 2017, dated May 5, 2017 (Pages 10).

(Continued)

*Primary Examiner* — Patrick D Hawn
(74) *Attorney, Agent, or Firm* — Robert Z. Evora, Esq.

(57) ABSTRACT

A bottle rack is provided. For example, a bottle rack can include a reservoir, a perforated tray and a first pivot housing member. The reservoir is for retention of a liquid. The perforated tray can enable the liquid to pass through to the reservoir. The first pivot housing member includes a first peg to hold an article. The first pivot housing member comprises an axle within the first pivot housing member. The first peg is rotatable via the axle.

12 Claims, 33 Drawing Sheets

(56) References Cited

U.S. PATENT DOCUMENTS 6,477,732 B1 * 11/2002 Cline ..... A45D 8/30 132/121
6,557,567 B2 * 5/2003 Mood ..... A47L 15/505 134/22.18
6,640,982 B1 11/2003 Bjerke
7,344,036 B2 * 3/2008 Jerstroem ..... A47L 19/04 211/184
7,458,470 B2 * 12/2008 Jerstroem ..... A47L 19/04 211/41.4
7,669,721 B2 * 3/2010 Kemper ..... A47L 19/04 211/126.1
7,682,465 B2 * 3/2010 Anderson ..... A47L 15/0084 134/56 D
8,167,147 B2 * 5/2012 Frankel ..... A47L 19/04 211/41.3
8,381,919 B2 * 2/2013 Amaral ..... A47L 15/505 211/41.9
8,408,403 B2 * 4/2013 Hedstrom ..... A47L 15/505 211/181.1
8,820,544 B2 * 9/2014 Lindgren ..... A47L 15/505 211/41.8
8,925,742 B1 1/2015 Chitayat et al.
8,925,743 B1 * 1/2015 Lee ..... A47L 19/04 211/41.6
8,960,452 B2 * 2/2015 Rhodes, II ..... A47L 19/04 211/41.6
9,107,552 B2 * 8/2015 Micek ..... A47L 19/04
2001/0047968 A1 * 12/2001 Wright ..... A47L 19/04 211/41.3
2002/0084233 A1 * 7/2002 Martorella ..... A47L 19/04 211/41.6
2004/0079713 A1 * 4/2004 Wendt ..... A47L 15/502 211/41.8
2004/0108283 A1 * 6/2004 Miilu ..... A47L 15/505 211/41.9
2004/0134866 A1 * 7/2004 Jerstroem ..... A47L 19/04 211/41.6
2006/0108298 A1 * 5/2006 Kim ..... A47L 15/503 211/41.8
2006/0289038 A1 * 12/2006 Hedstrom ..... A47L 15/503 134/25.2
2007/0125725 A1 * 6/2007 Kemper ..... A47L 19/04 211/41.3
2007/0272632 A1 11/2007 Jerstroem et al.
2008/0156750 A1 * 7/2008 Richardson ..... A47L 15/505 211/41.9
2008/0263762 A1 * 10/2008 Burns ..... A47J 47/20 4/657
2009/0301977 A1 * 12/2009 Amaral ..... A47L 15/505 211/41.8
2011/0253649 A1 * 10/2011 Clores ..... A47L 15/501 211/41.8
2012/0055891 A1 * 3/2012 Clores ..... A47L 15/501 211/41.8
2012/0306333 A1 * 12/2012 Eng ..... A47L 15/505 312/228.1
2013/0334941 A1 * 12/2013 Eng ..... A47L 15/505 312/228
2014/0263111 A1 9/2014 Micek et al.
2017/0245730 A1 * 8/2017 Dunn ..... A47L 19/02

OTHER PUBLICATIONS

European Search Report and Written Opinion for EP17757250-0-1018, dated Oct. 30, 2019. (Pages 6).

* cited by examiner

MODULAR BOTTLE RACK

RELATED APPLICATION

This application claims priority to U.S. Provisional Patent Application No. 62/300,053, filed Feb. 25, 2016, and entitled "MODULAR BOTTLE RACK", the entirety of which application is hereby incorporated by reference herein.

TECHNICAL FIELD

This disclosure relates generally to a bottle rack for storing and drying articles such as baby bottles. More specifically, this disclosure relates to a bottle rack comprising modular pegs.

BACKGROUND

A baby bottle is a bottle with a teat (also called a nipple) that can be used to throttle flow of liquid (e.g., as a baby drinks). Infants and young children typically use baby bottles when a mother does not breastfeed. In particular, a baby bottle can be used to feed infant formula, expressed breast milk, or pediatric electrolyte solution. A baby bottle typically comprise a baby bottle body, a collar, a ring, a nipple, a hood, a disk and/or other baby bottle elements which can be dried in a location that is separated from dirty water, potential contaminants, or other household dishware prior to storage for future use. Accessories for baby bottles can include, for example, cleaning brushes and bottle racks for drying the bottles. Bottle racks are racks used for drying the baby bottles in a hygienic manner. Ideally, baby bottles and nipples should be thoroughly scrubbed, sterilized, and completely dried to avoid contamination. Bottle racks can hold baby bottle body, a collar, a ring, a nipple, a hood, a disk and/or other baby bottle elements. Bottle racks can also comprise levels to facilitate collection of water in separate areas to decrease bacteria and mold growth. However, due to the rigid structure of current bottle racks, use of bottle racks can be cumbersome and/or not travel friendly.

The above-described background relating to baby bottles and bottle racks are merely intended to provide a contextual overview of bottle rack technology, and is not intended to be exhaustive. Other context regarding bottle racks may become further apparent upon review of the following detailed description.

SUMMARY

A simplified overview is provided herein to help enable a basic or general understanding of various aspects of exemplary, non-limiting embodiments that follow in the more detailed description and the accompanying drawings. This overview is not intended, however, as an extensive or exhaustive overview. Instead, the purpose of this overview is to present some concepts related to some exemplary non-limiting embodiments in simplified form as a prelude to more detailed descriptions of the various embodiments that follow in the disclosure.

In accordance with an example embodiment, an apparatus comprises a reservoir, a perforated tray and a first pivot housing member. The reservoir is for retention of a liquid. The perforated tray enables the liquid to pass through to the reservoir. The first pivot housing member comprises a first peg to hold an article. The first pivot housing member comprises an axle within the first pivot housing member. The first peg is rotatable via the axle.

In accordance with another example embodiment, an apparatus comprises a reservoir, a perforated tray and a first modular pivot housing. The reservoir retains a liquid. The perforated tray allows the liquid to pass through to the reservoir. The first modular pivot housing member comprises a base and a peg structure. The base comprises at least one support mount adapted to be removably connected to the perforated tray. The peg structure comprises an axle and a first peg. The axle is rotatably connected to the base. The first peg extends from the axle and is adapted to hold an item to be drip dried. The first peg is rotatable via the axle between a first upright open position and a second compacted storage position.

In accordance with yet another example embodiment, an apparatus comprises a reservoir, a perforated tray and a first pivot housing member. The reservoir is for retaining liquid. The perforated tray is for allowing liquid to pass through to the reservoir via a first mounting hole of the perforated tray. The structure comprises a modular peg for supporting an article. Furthermore, the structure is attached to the perforated tray via a second mounting hole of the perforated tray.

The following description and the annexed drawings set forth certain illustrative aspects of the specification. These aspects are indicative, however, of but a few of the various ways in which the principles of the specification may be employed. Other advantages and novel features of the specification will become apparent from the following detailed description of the specification when considered in conjunction with the drawings.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
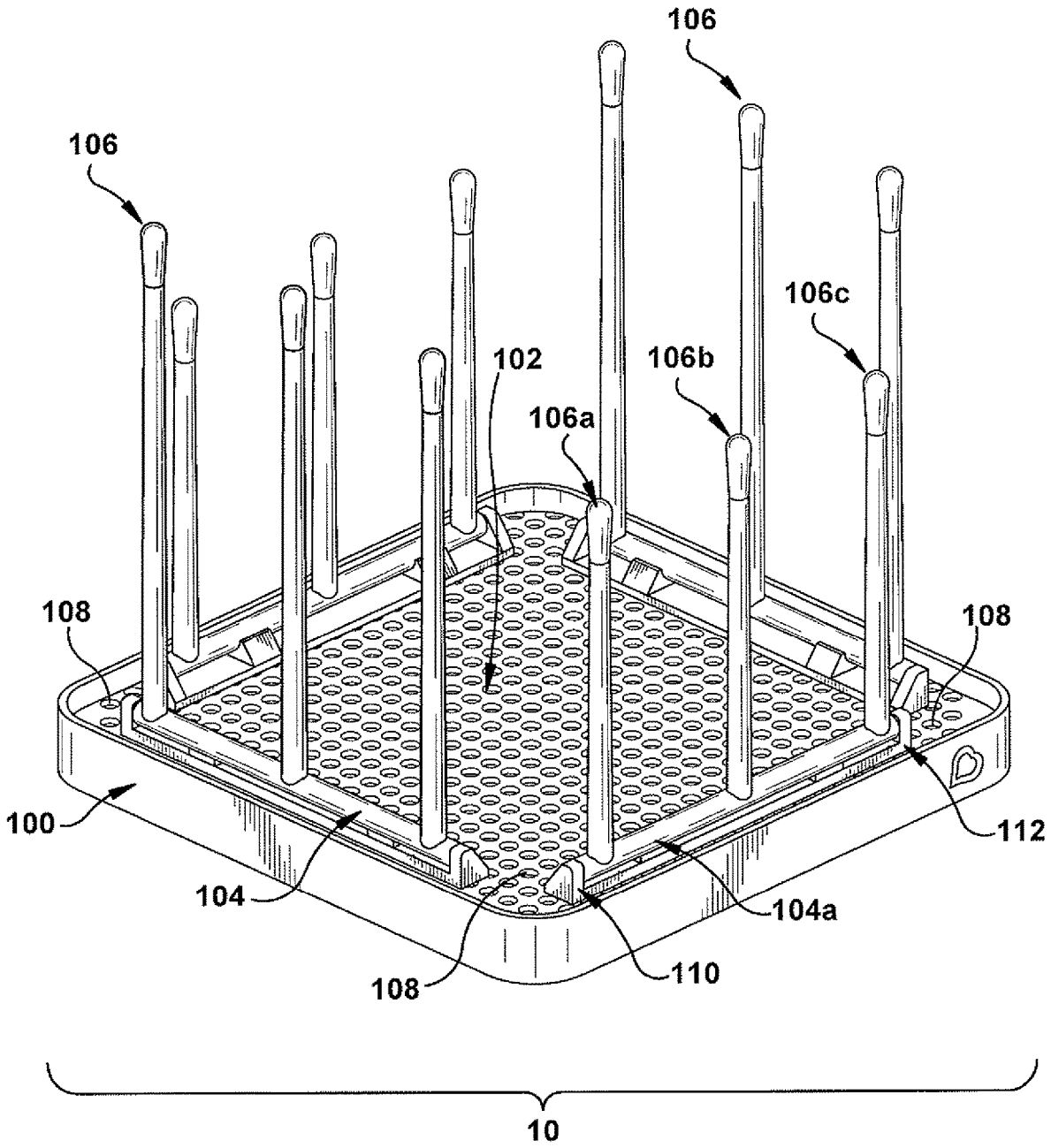
FIG. 1 illustrates an example schematic of a perspective view of a bottle rack comprising modular pegs in accordance with one or more embodiments described herein.

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

As an overview of the various embodiments presented herein, to correct for the above-identified deficiencies and other drawbacks of bottle racks, various embodiments are described herein to facilitate a modular bottle rack. Described herein are systems, methods, articles of manufacture, and other embodiments or implementations that can facilitate the use of modular bottle racks. Modular bottle racks can be implemented in connection with any type of bottle or device needing to be air dried, such as a cup, a bowl, or the like. A variety of bottle racks on the market suffer from lack of modularity due to their rigid or complex structure. However, the embodiments of the modular bottle rack presented herein provide several advantages such as an ease of storage, ease of use, and is travel friendly. The embodiments of the modular bottle rack presented herein also provide several advantages such as improved drying performance for articles (e.g., baby bottles and/or baby bottle elements) associated with the modular bottle rack, an increased number of articles (e.g., baby bottles and/or baby bottle elements) capable of being supported by the modular bottle rack, etc.

In an embodiment, a bottle rack (e.g., a modular bottle rack) can comprise a reservoir, a perforated tray, a pivot housing, and pegs. The pivot housings can be rearranged in various positions to accommodate various bottle sizes. The pivot housings can also enable the pegs to be folded in an inward position (e.g., folded approximately flushly in an inward position) to facilitate compact storage and/or travel for the bottle rack. In another an embodiment, a bottle rack (e.g., a modular bottle rack) can comprise a reservoir that retains liquid during a bottle drying process. The reservoir can be of various sizes, widths, and heights depending upon a volume of liquid to be retained. For instance, for larger bottles that will drip more water than smaller bottles, during a drying process, the bottle rack can comprise a larger reservoir to ensure that the liquid does not overrun the reservoir. The reservoir can also comprise several posts to elevate a perforated tray, which can sit within the reservoir. Based on a height of the posts, the perforated tray can sit at various heights within the reservoir or sit flush with a top of the reservoir. Posts of various heights can also be used to orient the perforated tray at a slope relative to the reservoir. Consequently, perforations within the tray can enable liquid draining from bottles to pass through the perforated tray and be retained by the reservoir.

The perforations within the tray can also serve as mounting holes to stabilize mounts on a pivot housing. The pivot housing mounts can be configured to fit within the mounting holes when the pivot housing is pressed onto the perforated tray. In an embodiment, the pivot housing can comprise a rotating axle, which can rotate therein, thereby enabling pegs attached to the pivot housing to be rotated. Additionally, each peg can have an independent axle in relation to the other pegs associated with a specific pivot housing, thereby enabling each peg to rotate independently of other pegs within the same pivot housing. The pegs can be rotated at various angles and degrees relative to the pivot housing to provide maximal use of space associated with the bottle rack. For instance, the pegs can be rotated to a ninety-degree angle relative to the perforated tray or they can be rotated at an obtuse angle relative to the perforated tray to facilitate drying of larger bottles. The pegs can also be of varying heights and widths to accommodate a wide array of different bottle types and sizes. It should be noted that one pivot housing can comprise various shaped and sized pegs. It should also be noted that the pivot housing and axle system can leverage friction to help stabilize the pegs at any position (e.g., when under stress from weight of the bottles). Additionally, the pegs can comprise, for example, a bulb-like member at a distal end to assist in situating bottles thereon.

In an aspect, a pivot housing can also be configured in a linear shape or anon-linear shape to facilitate maximal use of a surface area of a perforated tray. Since a pivot housing can be modular with respect a perforated tray, a pivot housing can be oriented in various configurations to provide maximum efficiency. For example, in certain embodiments, two pivot housings can be attached to a perforated tray to facilitate drying of larger bottles. Alternatively, in another example embodiment, four pivot housings can be attached to a perforated tray to facilitate drying of several smaller bottles. It is to be appreciated that a pivot housings can be aligned in a parallel, perpendicular, adjacent, and/or diagonal orientation to each other and/or to a particular reference point of the perforated tray.

For compact storage or ease of travel, pegs of the bottle rack can be inwardly rotated, via a pivot housing, so that the pegs overlay/overlap each other and/or are parallel to a perforated tray. Additionally or alternatively, a height of a pivot housing can be varied to allow first pivot housings (e.g., first pivot housings comprising pegs) in a first orientation to overlay second pivot housings (e.g., second pivot housings comprising pegs) in a second orientation. Thus, to facilitate the aforementioned example, the first pivot housings in the first orientation can be taller than the second pivot housings in the second orientation so that the first pivot housings in the first orientation will overlay the second pivot housings in the second orientation. Furthermore, in another embodiment, one or more pegs of the bottle rack can have one or more recesses to facilitate a flush peg cross-alignment if pivot housings comprise a corresponding height.

These and other embodiments or implementations are described in more detail below with reference to the drawings. FIGS. 1-35 illustrate apparatuses and methods that can facilitate air drying of bottles. For simplicity of explanation, the methods are depicted and described as a series of acts. It is to be understood and appreciated that the various embodiments are not limited by the acts illustrated and/or by the order of acts. For example, acts can occur in various orders and/or concurrently, and with other acts not presented or described herein. Furthermore, not all illustrated acts may be required to implement the methods. In addition, the methods could alternatively be represented as a series of interrelated states via a state diagram or events.

Referring now to FIG. 1, illustrated is an example schematic of a perspective view of a bottle rack 10 in accordance with one or more embodiments described herein. The bottle rack 10 can be, for example, a modular bottle rack that comprises a set of parts that together form the bottle rack 10. In one example, the bottle rack 10 can be a drying rack. The bottle rack 10 can include a reservoir 100. The reservoir 100 can be formed as a container capable of being filled with a liquid. For instance, the reservoir 100 can include a bottom surface and a set of wall surfaces configured to retain a fluid such as, for example, water or another fluid. The set of wall surfaces of the reservoir 100 can be a defined height to retain a liquid. In one example, the reservoir 100 that can retain a liquid transferred from one or more articles during a drying process associated with the one or more articles. For instance, a drying process can occur after washing and/or rinsing the one or more articles. In another example, the reservoir 100 can be a drip tray for one or more articles associated with the drying process. An article can include, for example, an item or an object such as a baby bottle, a baby bottle body, a baby bottle nipple, a baby bottle collar, a baby bottle ring, a baby bottle hood, a baby bottle disk, a baby bottle accessory, a pump accessory, a cup, tableware, a snacking container, or another type of article.

In an embodiment, the reservoir 100 can retain a perforated tray 102. The perforated tray 102 can include a set of mounting holes 108. The set of mounting holes 108 can be a set of perforations that enable passage of liquid to the bottom surface of the reservoir 100. One or more pivot housings 104 can be formed on a surface of the perforated tray 102. A pivot housing 104 can include a set of modular pegs 106. The set of modular pegs 106 can be, for example, drying pegs (e.g., moveable drying pegs). A pivot housing 104 can also comprise a rotating axle to enable one or more modular pegs 106 to freely rotate about the rotating axle of the pivot housing 104. For instance, a pivot housing 104 can be a structure (e.g., a pivot housing member, a modular pivot housing member, etc.) that can comprise a rotating axle that enables one or more modular pegs 106 to rotate up to an orientation approximately perpendicular to a surface of the perforated tray 102 (e.g., enable one or more modular pegs 106 to be in an upright position) and/or down to an orientation approximately parallel to a surface of the perforated tray 102 (e.g., enable one or more modular pegs 106 to be in a semi-compacted position). In one example embodiment, a pivot housing 104*a* can include a first modular peg 106*a*, a second modular peg 106*b* and a third modular peg 106*c*. The first modular peg 106*a*, the second modular peg 106*b* and the third modular peg 106*c* can be extensions from the pivot housing 104*a* such that rotation of the pivot housing 104*a* can result in rotation of the first modular peg 106*a*, the second modular peg 106*b* and the third modular peg 106*c*. In an aspect, the one or more modular pegs 106 can be employed to support one or more articles during a drying process associated with the one or more articles. For example, the first modular peg 106*a* can support a first article, the second modular peg 106*b* can support a second article and/or the third modular peg 106*c* can support a third article during a drying process associated with the first article, the second article and/or the third article. Furthermore, the first article can be removed from the first modular peg 106*a*, the second article can be removed from the second modular peg 106*b* and/or the third article can be removed from the third modular peg 106*c*, for example, after completion of the drying process associated with the first article, the second article and/or the third article. In an embodiment, the pivot housing 104*a* can comprise a first fixed end portion 110 and a second fixed end portion 112. A portion of the rotating axle of the pivot housing 104*a* can extend into the first fixed end portion 110 and the second fixed end portion 112 such that the portion the rotating axle of the pivot housing 104*a* can rotate within the first fixed end portion 110 and the second fixed end portion 112. In another embodiment, the one or more pivot housings 104 can be attachable and/or removable with respect to the perforated tray 102. For instance, a pivot housing 104 can include a set of pegs configured to fit within the set of mounting holes 108 of the perforated tray 102. In one example, the one or more modular pegs 106 can be formed from plastic material. In another example, the one or more modular pegs 106 can be formed from metal material. In a non-limiting example, the reservoir 100 can be formed from a plastic material and/or stainless-steel, the perforated tray 102 can be formed from stainless steel, and the one or more modular pegs 106 can be formed from a plastic material.

Figure 2:
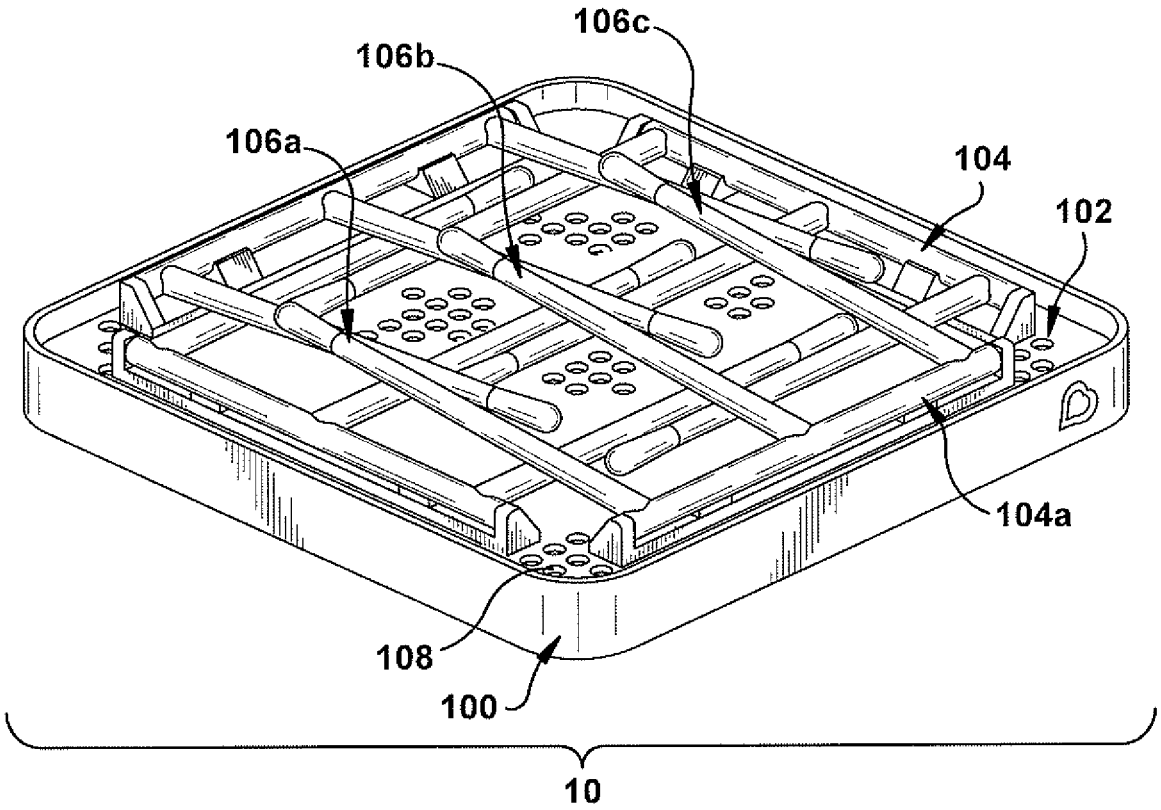
FIG. 2 illustrates an example schematic of a perspective view of a bottle rack comprising modular pegs in a semi-compacted position in accordance with one or more embodiments described herein.

Referring now to FIG. 2, illustrated is another example schematic of a perspective view of the bottle rack 10 in accordance with one or more embodiments described herein. In FIG. 2, a pivot housing 104 of the bottle rack 10 can be rotated to enable one or more modular pegs 106 to rotate down to an orientation approximately parallel to a surface of the perforated tray 102 (e.g., enable one or more modular pegs 106 to be in a semi-compacted position). For example, the first modular peg 106*a*, the second modular peg 106*b* and the third modular peg 106*c* can be rotated down to an orientation approximately parallel to a surface of the perforated tray 102 (e.g., the first modular peg 106*a*, the second modular peg 106*b* and the third modular peg 106*c* can be in a semi-compacted position). As such, one or more modular pegs 106 of the bottle rack 10 can be moveable with respect to a surface of the perforated tray 102. In one example, a configuration of the bottle rack 10 shown in FIG. 2 can be employed for storage of the bottle rack 10 and/or travelling with the bottle rack 10 due to the reduced space utilized by the bottle rack 10.

Figure 3:
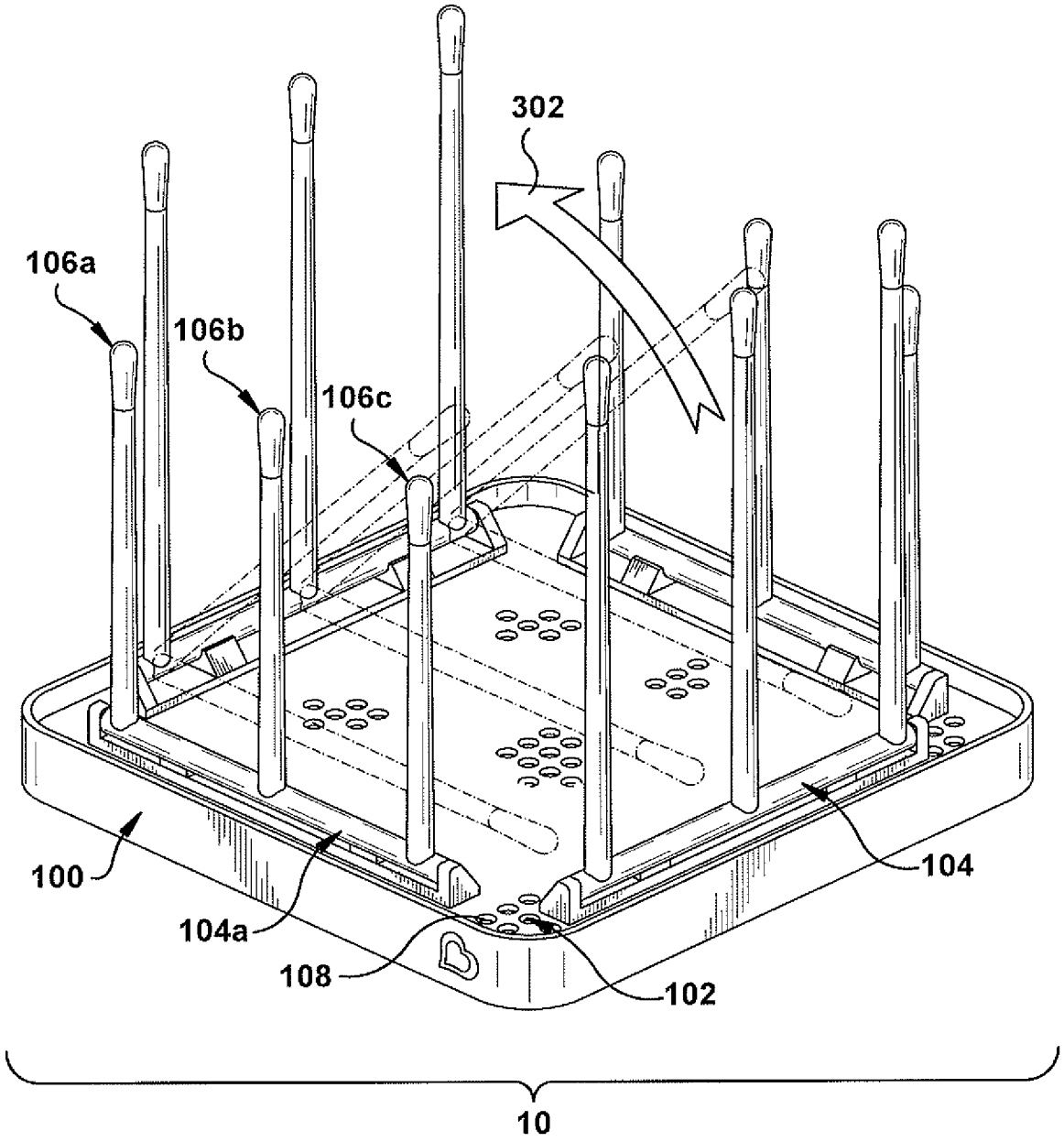
FIG. 3 illustrates an example schematic of a perspective view of a bottle rack comprising modular pegs in transition from a compacted position to an upright position in accordance with one or more embodiments described herein.

Referring now to FIG. 3, illustrated is yet another example schematic of a perspective view of the bottle rack 10 in accordance with one or more embodiments described herein. In FIG. 3, a pivot housing 104 of the bottle rack 10 can be rotated to enable one or more modular pegs 106 to rotate up to an orientation approximately perpendicular to a surface of the perforated tray 102 (e.g., enable one or more modular pegs 106 to be in a semi-compacted position). For instance, the one or more modular pegs 106 can be movable between a first position (e.g. a storage position where the one or more modular pegs 106 are approximately parallel to a surface of the perforated tray 102) and a second position (e.g., an operative position where the one or more modular pegs are approximately perpendicular to a surface of the perforated tray 102). In one example, the first modular peg 106*a*, the second modular peg 106*b* and the third modular peg 106*c* can be rotated up to an orientation approximately perpendicular to a surface of the perforated tray 102 via a motion process 302 (e.g., the first modular peg 106*a*, the second modular peg 106*b* and the third modular peg 106*c* can be in an upright position). The motion process 302 can involve, for example, swinging the first modular peg 106*a*, the second modular peg 106*b* and the third modular peg 106*c* by rotating the pivot housing 104. In one example, a configuration of the bottle rack 10 shown in FIG. 3 can be employed during a drying process for one or more articles placed on the bottle rack 10. It is to be appreciated that although the bottle rack 10 can be employed while one or more modular pegs 106 are in a fully upright position, the bottle rack 10 can also be employed during any transitional point from FIG. 2 to FIG. 3 due to friction.

Figure 4:
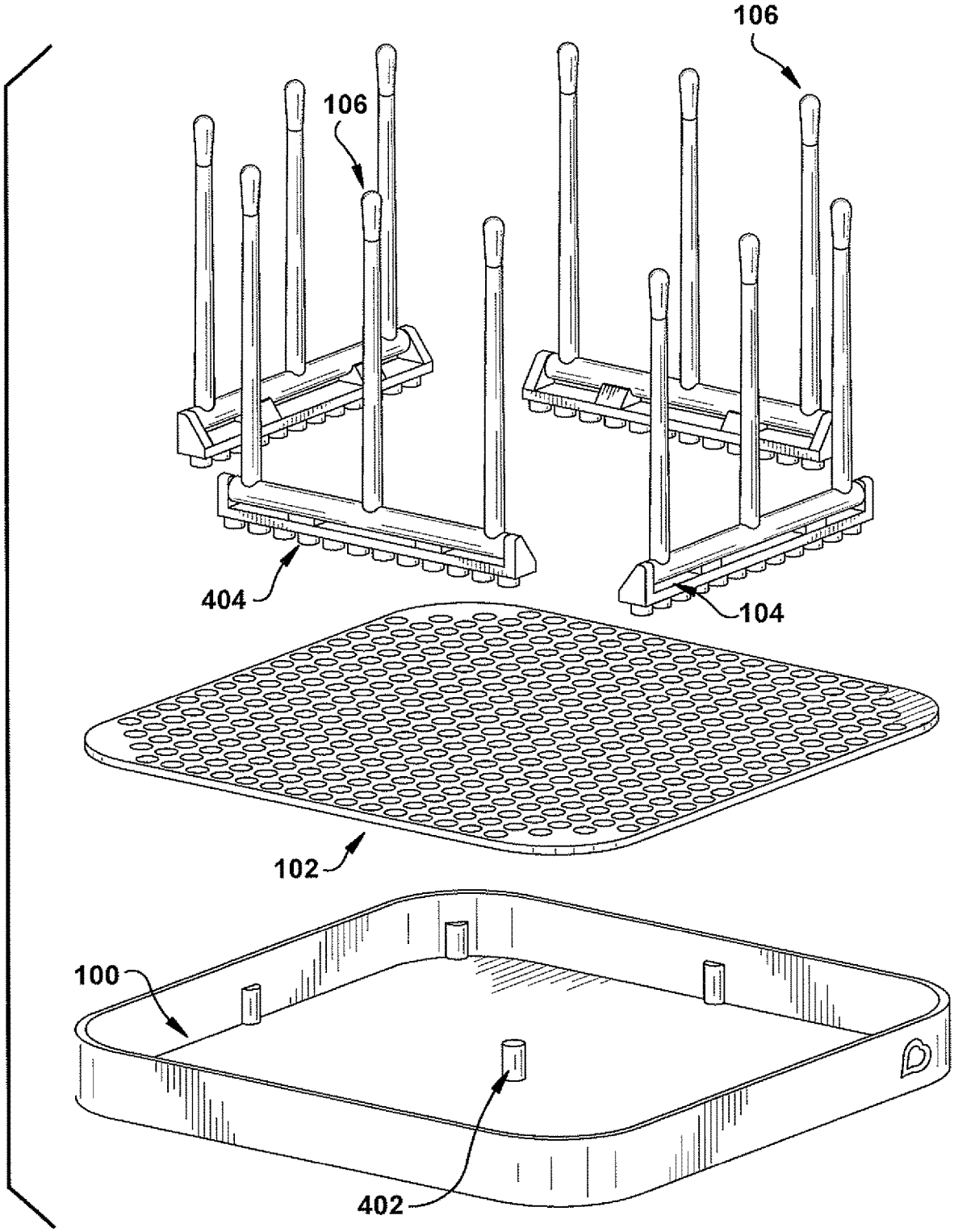
FIG. 4 illustrates an example schematic of an exploded view of a bottle rack in accordance with one or more embodiments described herein.

Referring now to FIG. 4, illustrated is an example exploded view of the bottle rack 10 in accordance with one or more embodiments described herein. The reservoir 100 of the bottle rack 10 can include various structures to facilitate attachment of the perforated tray 102 to the reservoir 100. In an embodiment, the reservoir 100 can include one or more posts 402. The one or more posts 402 can be employed to elevate the perforated tray 102 above the reservoir 100. The one or more posts 402 can additionally or alternatively facilitate alignment of the perforated tray 102 within the reservoir 100. For instance, the one or more posts 402 can position the perforated tray 102. It is to be appreciated that, in certain embodiments, the one or more posts 402 can include multiple posts 402 at multiple locations associated with the reservoir 100 to facilitate stabilization of the perforated tray 102. In an aspect, a post 402 can align with and/or fit within a mounting hole from the set of mounting holes 108. In another aspect, the one or more posts 402 can enable the perforated tray 102 to be placed at a variety of angles and/or heights relative to the reservoir 100. A size and/or a shape of the one or more posts 402 can correspond to a size and/or a shape of a mounting hole from the set of mounting holes 108. In another embodiment, a pivot housing 104 can include a set of posts 404. The set of posts 404 can be a set of mounts on a surface of a pivot housing 104 (e.g., an underside surface of a pivot housing 104 opposite to another surface that comprises one or more modular pegs 106) to enable the pivot housing 104 to be mounted to a portion of the set of mounting holes 108. The set of posts 404 can align with and/or fit within at least a portion of the set of mounting holes 108. For instance, the set of posts 404 can facilitate alignment of a pivot housing 104 with respect to the perforated tray 102, where the set of mounting holes 108 of the perforated tray 102 accommodates the set of posts 404. In one example, a particular number of posts from the set of posts 404 can fit within a corresponding number of mounting holes from the set of mounting holes 108. In an aspect, the set of posts 404 can align with and/or fit within at least a portion of the set of mounting holes 108. In another aspect, the set of posts 404 can enable a pivot housing 104 to be placed at a variety of positions relative to the perforated tray 102. A size and/or a shape of the set of posts 404 can correspond to a size and/or a shape of the set of mounting holes 108. In an embodiment, a pivot housing 104 can comprise a base portion that comprises the set of posts 404. The set of posts 404 can be a support mount adapted to be removably connected to the perforated tray 102. A pivot housing 104 can also comprise a peg structure that can comprise an axle rotatably connected to the base portion. A modular peg 106 can extend from the axle and can be adapted to hold an article to be, for example, drip dried. A modular peg 106 can also be rotatable via the axle between a first upright open position and a second compacted storage position (e.g., as shown in FIG. 3). In another embodiment, the perforated tray 102 can allow liquid to pass through to the reservoir 100 via a first mounting hole 108 of the perforated tray 102. Furthermore, the pivot housing 104 can comprise one or more modular pegs 106 and can be attached to the perforated tray via at least a second mounting hole 108 of the perforated tray 102. Moreover, a post 402 can align the perforated tray 102 via a third mounting hole 108 of the perforated tray 102.

Figure 5:
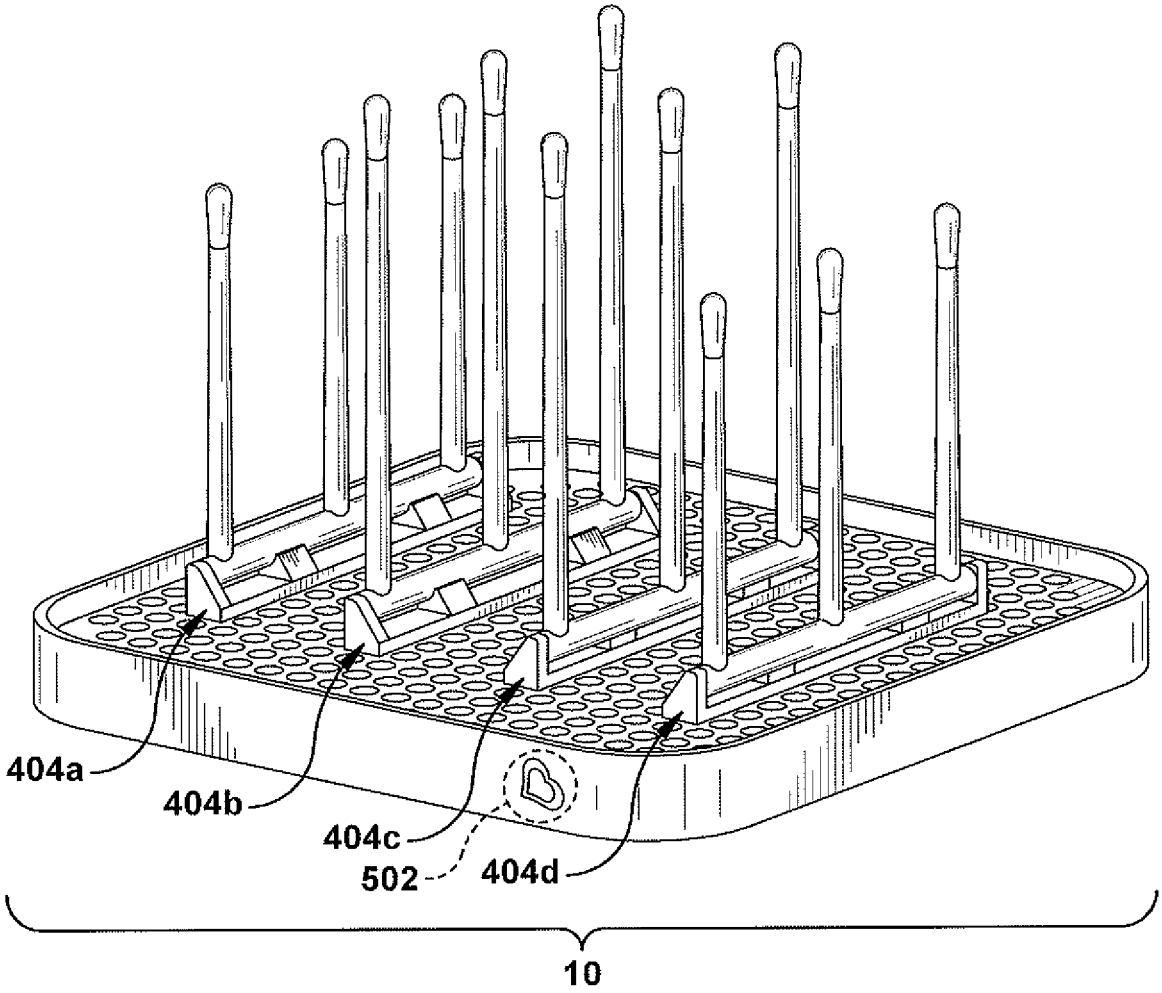
FIG. 5 illustrates an example schematic of a perspective view of a bottle rack in accordance with one or more embodiments described herein.

Referring now to FIG. 5, illustrated is an example perspective view of the bottle rack 10 in accordance with one or more embodiments described herein. In FIG. 5, a pivot housing 104*a* can be associated with a first orientation with respect to the perforated tray 102, a pivot housing 104*b* can be associated with a second orientation with respect to the perforated tray 102, a pivot housing 104*c* can be associated with a third orientation with respect to the perforated tray 102, and a pivot housing 104*d* can be associated with a fourth orientation with respect to the perforated tray 102. In an aspect, the first orientation associated with the pivot housing 104*a*, the second orientation associated with the pivot housing 104*b*, the third orientation associated with the pivot housing 104*c* and/or the fourth orientation associated with the pivot housing 104*d* can be modified to a different orientation. For instance, the first orientation associated with the pivot housing 104*a*, the second orientation associated with the pivot housing 104*b*, the third orientation associated with the pivot housing 104*c* and/or the fourth orientation associated with the pivot housing 104*d* can be modified to a different orientation as shown in, for example, FIG. 1. In a non-limiting example, the reservoir 100 can include a marking 502 that can be considered a front side of the bottle rack 10 for illustrative purposes. As illustrated in FIG. 5, the pivot housings 104*a-d* can be oriented in a perpendicular orientation with respect to the marking 502. Furthermore, the pivot housings 104*a-d* can be oriented parallel to each other. For instance, the pivot housing 104*a* can be oriented parallel to the pivot housing 104*b*, the pivot housing 104*c* and/or the pivot housing 104*d*.

Figure 6:
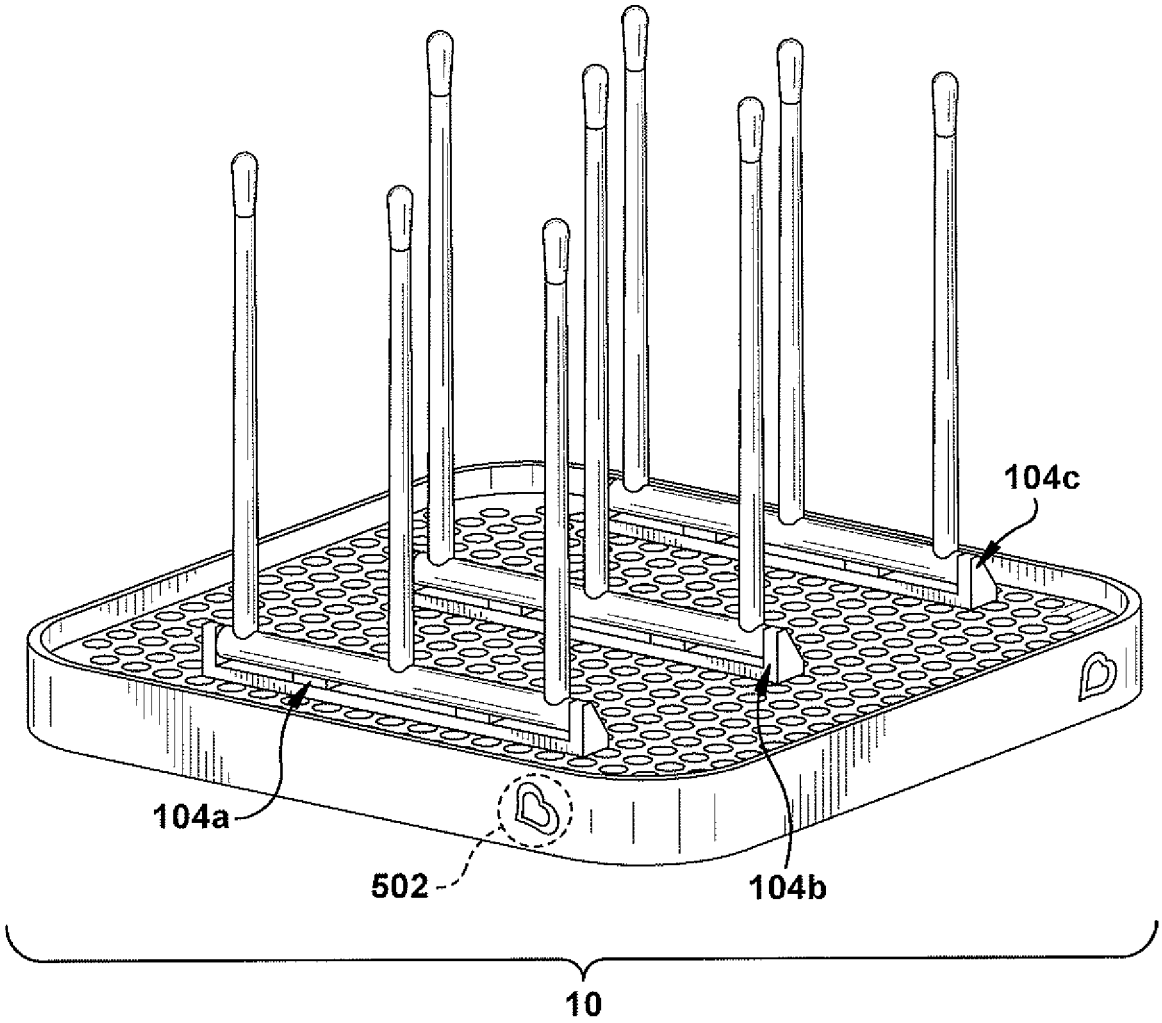
FIG. 6 illustrates an example schematic of a perspective view of a bottle rack comprising modular pegs in a parallel orientation in accordance with one or more embodiments described herein.

Referring now to FIG. 6, illustrated is an example perspective view of the bottle rack 10 in accordance with one or more embodiments described herein. In FIG. 6, the pivot housing 104*a* can be associated with a fifth orientation with respect to the perforated tray 102 that is different than the first orientation shown in FIG. 5, a pivot housing 104*b* can be associated with a sixth orientation with respect to the perforated tray 102 that is different than the second orientation shown in FIG. 5, and the pivot housing 104*c* can be associated with a seventh orientation with respect to the perforated tray 102 that is different than the third orientation shown in FIG. 5. The pivot housing 104*d* can be removed from the perforated tray 102, for example, in FIG. 6. In a non-limiting example, the reservoir 100 can include the marking 502 that can be considered a front side of the bottle rack 10 for illustrative purposes. As illustrated in FIG. 6, the pivot housings 104*a-c* can be oriented in a parallel orientation with respect to the marking 502. Furthermore, the pivot housings 104*a-c* can be oriented parallel to each other. As such, the pivot housings 104*a-d* and/or one or more modular pegs 106 associated with the pivot housings 104*a-d* can be moveable and/or reoriented with respect to the perforated tray 102 to accommodate one or more articles. In certain embodiments, a pivot housing 104 can be aligned diagonally with respect to a side of the reservoir 100.

Figure 7:
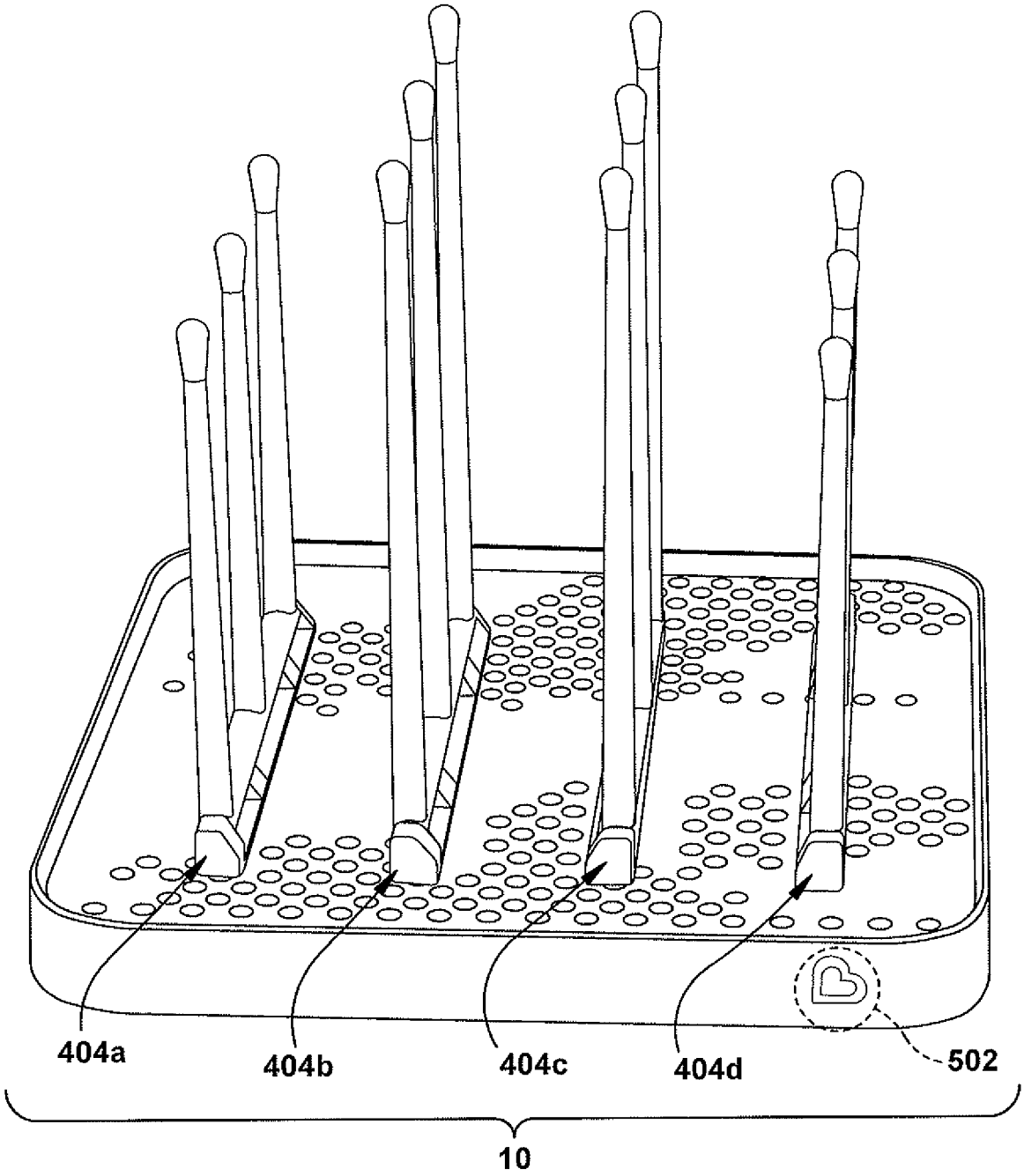
FIG. 7 illustrates an example schematic of a perspective view of a bottle rack comprising modular pegs in a perpendicular orientation in accordance with one or more embodiments described herein.

Referring now to FIG. 7, illustrated is an example perspective view of the bottle rack 10 in accordance with one or more embodiments described herein. In FIG. 7, modular pegs of the pivot housing 104*a* and the pivot housing 104*d* can comprise a corresponding height. Furthermore, modular pegs of the pivot housing 104*b* and the pivot housing 104*c* can comprise a corresponding height that is different than a height associated with the pivot housing 104*a* and the pivot housing 104*d*. For instance, modular pegs of the pivot housing 104*a* and the pivot housing 104*d* can comprise a first height. Furthermore, modular pegs of the pivot housing 104*b* and the pivot housing 104*c* can comprise a second height. In one example, the second height associated with modular pegs of the pivot housing 104*b* and the pivot housing 104*c* can be greater than the first height associated with modular pegs of the pivot housing 104*a* and the pivot housing 104*d*. In another example, the second height associated with modular pegs of the pivot housing 104*b* and the pivot housing 104*c* can be less than the first height associated with modular pegs of the pivot housing 104*a* and the pivot housing 104*d*. In certain embodiments, a height of the pivot housings 104*a-d* can additionally or alternatively be varied to facilitate movement of one or more modular pegs 106. For example, the pivot housing 104*a* can comprises a different height than the pivot housing 104*b*.

Figure 8:
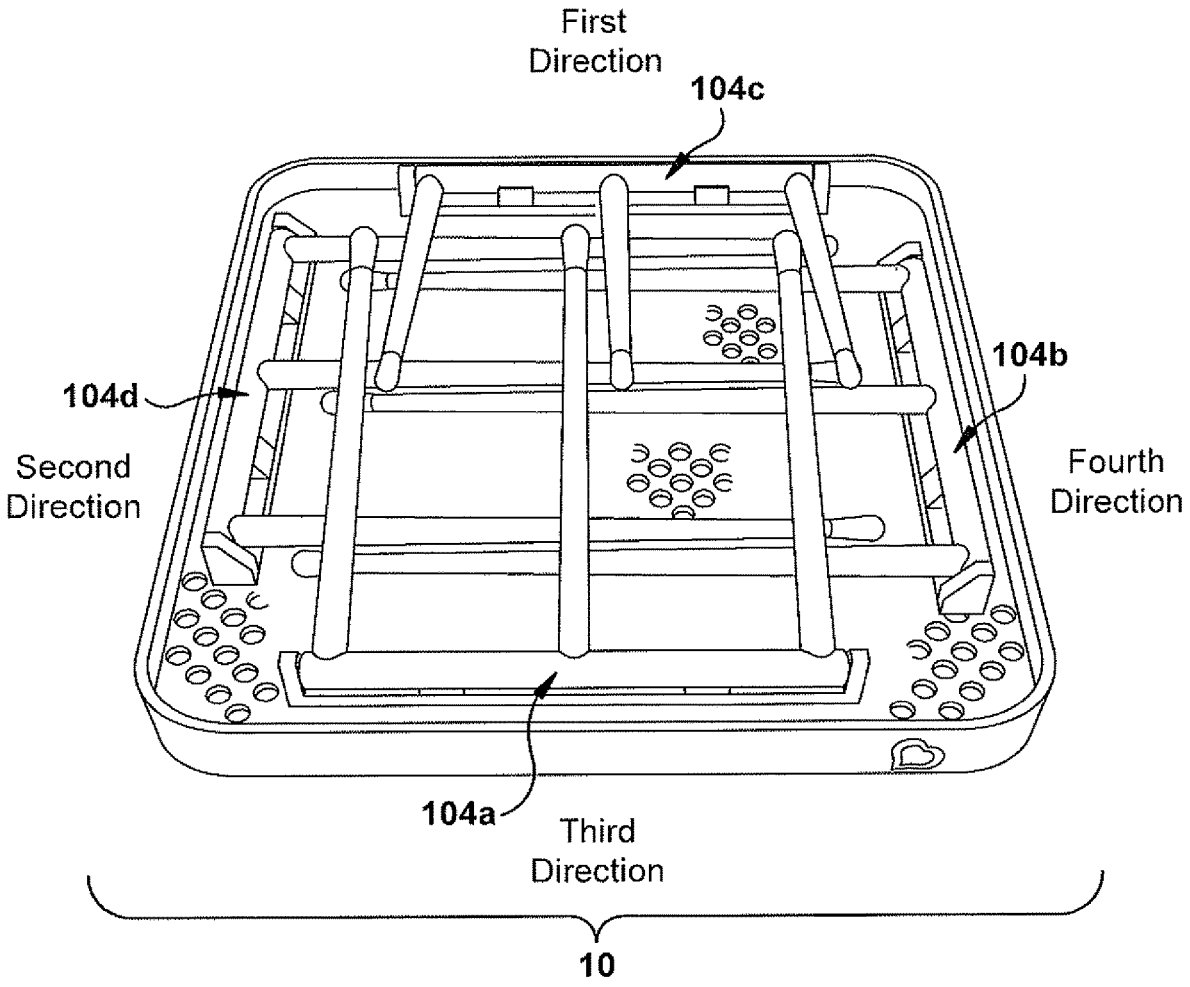
FIG. 8 illustrates an example schematic of a perspective view of a bottle rack comprising modular pegs in a compacted position in accordance with one or more embodiments described herein.

Referring now to FIG. 8, illustrated is an example perspective view of the bottle rack 10 in accordance with one or more embodiments described herein. In FIG. 8, the pivot housings 104*a-d* can be rotated down to an orientation approximately parallel to a surface of the perforated tray 102 (e.g., to allow modular pegs 106 associated with the pivot housings 104*a-d* to be in a semi-compacted position). In an aspect, the pivot housing 104*a* can be rotated to allow modular pegs 106 of the pivot housing 104*a* to be oriented toward a first direction, the pivot housing 104*b* can be rotated to allow modular pegs 106 of the pivot housing 104*b* to be oriented toward a second direction, the pivot housing 104*c* can be rotated to allow modular pegs 106 of the pivot housing 104*c* to be oriented toward a third direction, and the pivot housing 104*d* can be rotated to allow modular pegs 106 of the pivot housing 104*d* to be oriented toward a fourth direction. To facilitate the aforementioned orientations and allow the pegs to lay flush with each other, a height of the pivot housing 104*b* and the pivot housing 104*c* can be taller than a height of the pivot housing 104*a* and the pivot housing 104*d*, or vice versa. Alternatively, one or more modular pegs 106 associated with the pivot housings 104*a-d* can comprise one or more recesses to accommodate one or more other modular pegs 106 to lay within the one or more recesses to create a flush compacted bottle rack 10 in a semi-compacted position.

Figure 9:
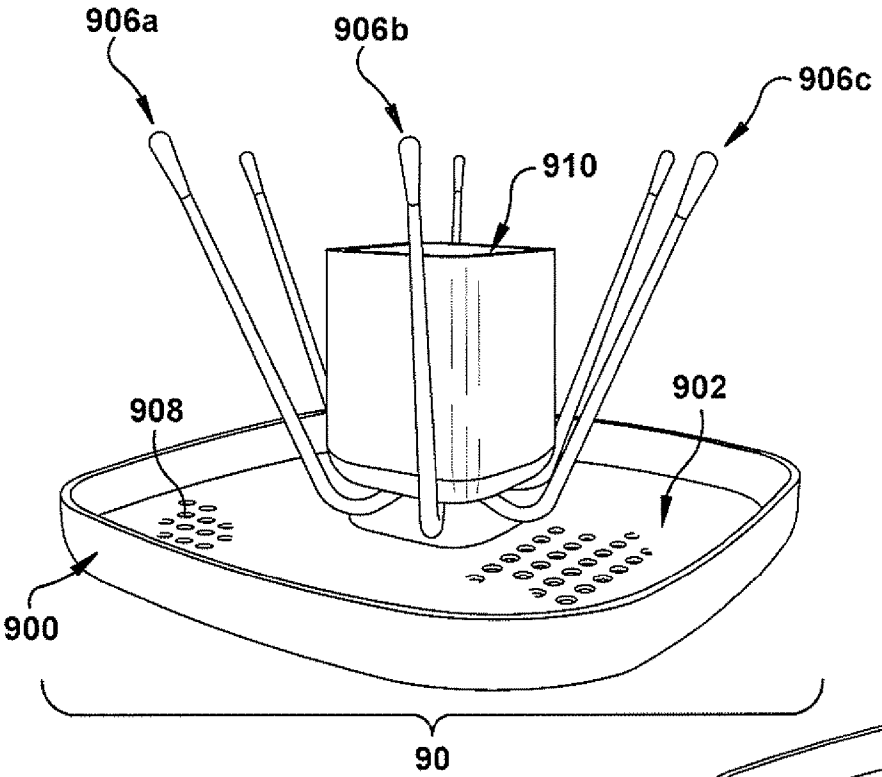
FIG. 9 illustrates an example schematic of a perspective view of a bottle rack in accordance with one or more embodiments described herein.

Referring now to FIG. 9, illustrated is an example schematic of a perspective view of a bottle rack 90 in accordance with one or more embodiments described herein. The bottle rack 90 can include a reservoir 900. The reservoir 900 can be formed as a container capable of being filled with a liquid. For instance, the reservoir 900 can include a bottom surface and a set of wall surfaces configured to retain a fluid such as, for example, water or another fluid. The set of wall surfaces of the reservoir 900 can be a defined height to retain a liquid. In one example, the reservoir 900 that can retain a liquid transferred from one or more articles (e.g., one or more baby bottles) during a drying process associated with the one or more articles. For instance, a drying process can occur after washing and/or rinsing the one or more articles (e.g., one or more baby bottles).

In an aspect, the reservoir 900 can retain a perforated tray 902. The perforated tray 902 can include a set of mounting holes 908. The set of mounting holes 908 can be a set of perforations that enable passage of liquid to the bottom surface of the reservoir 900. In another aspect, the bottle rack 90 can include a base member 910. The base member 910 can include a concave portion to retain one or more objects. For instance, the base member 910 can be a vessel structure with an opening and a hollow container that retains one or more objects. In one example, the base member 910 can be a cup member to hold one or more objects. In yet another aspect, one or more modular pegs 906 can be attached to the base member 910. The one or more modular pegs 906 can be employed to support one or more articles (e.g., one or more bottles) during a drying process associated with the one or more articles. For example, a first modular peg 906*a* can support a first article, a second modular peg 906*b* can support a second article and/or a third modular peg 906*c* can support a third article during a drying process associated with the first article, the second article and/or the third article. Furthermore, the first article can be removed from the first modular peg 906*a*, the second article can be removed from the second modular peg 906*b* and/or the third article can be removed from the third modular peg 906*c*, for example, after completion of the drying process associated with the first article, the second article and/or the third article. In an embodiment, the base member 910 can be attachable and/or removable with respect to the perforated tray 902. For instance, the base member 910 can include a set of pegs configured to fit within the set of mounting holes 908 of the perforated tray 902. In one example, the one or more modular pegs 906 can be formed from plastic material. In another example, the one or more modular pegs 906 can be formed from metal material.

Figure 10:
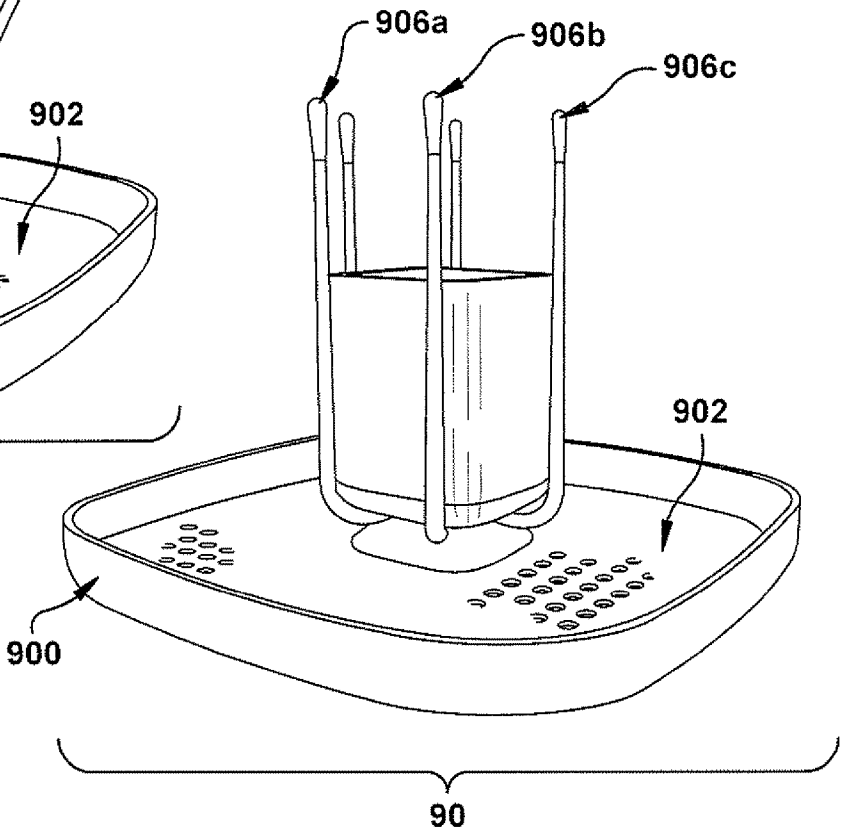
FIG. 10 illustrates another example schematic of a perspective view of a bottle rack in accordance with one or more embodiments described herein.

Referring now to FIG. 10, illustrated is an example schematic of a perspective view of the bottle rack 90 in accordance with one or more embodiments described herein. In FIG. 10, an orientation of the one or more modular pegs 906 can be modified. For instance, the first modular peg 906*a*, the second modular peg 906*b* and/or the third modular peg 906*c* can be oriented in an upright position, as opposed to an extended position shown in FIG. 9.

Figure 11:
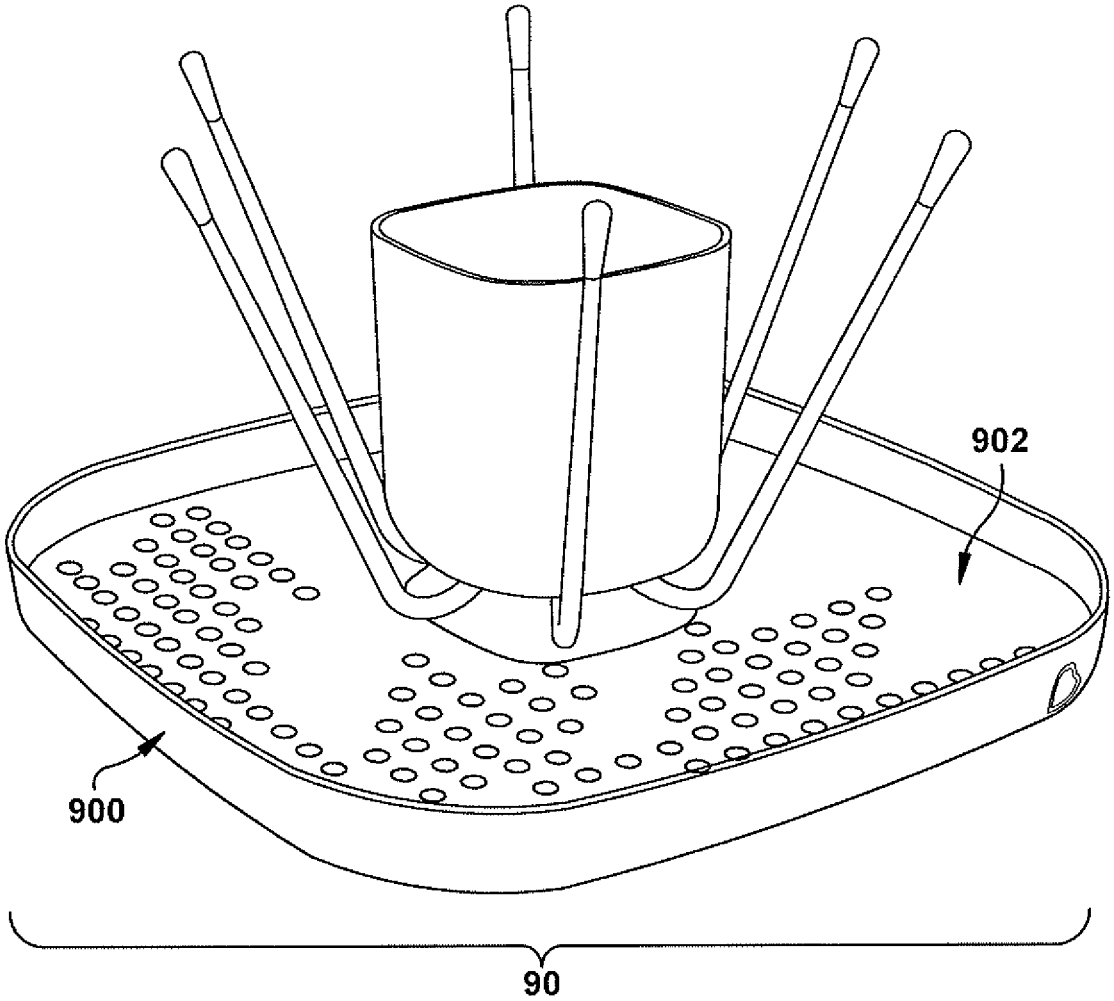
FIG. 11 illustrates yet another example schematic of a perspective view of a bottle rack in accordance with one or more embodiments described herein.

Referring now to FIG. 11, illustrated is an example schematic of a perspective view of the bottle rack 90 in accordance with one or more embodiments described herein. In an embodiment, the reservoir 900 can comprise a first type of material and the perforated tray 902 can comprises a second type of material that is different than the first type of material associated with the reservoir 900. For example, the reservoir 900 can comprise a plastic material and the perforated tray 902 can comprises a metal material (e.g., stainless steel). In another embodiment, the reservoir 900 and the perforated tray 902 can comprises a corresponding type of material. In one example, the reservoir 900 and the perforated tray 902 can comprise a plastic material. In another example, the reservoir 900 and the perforated tray 902 can comprise a metal material (e.g., stainless steel).

Figure 12:
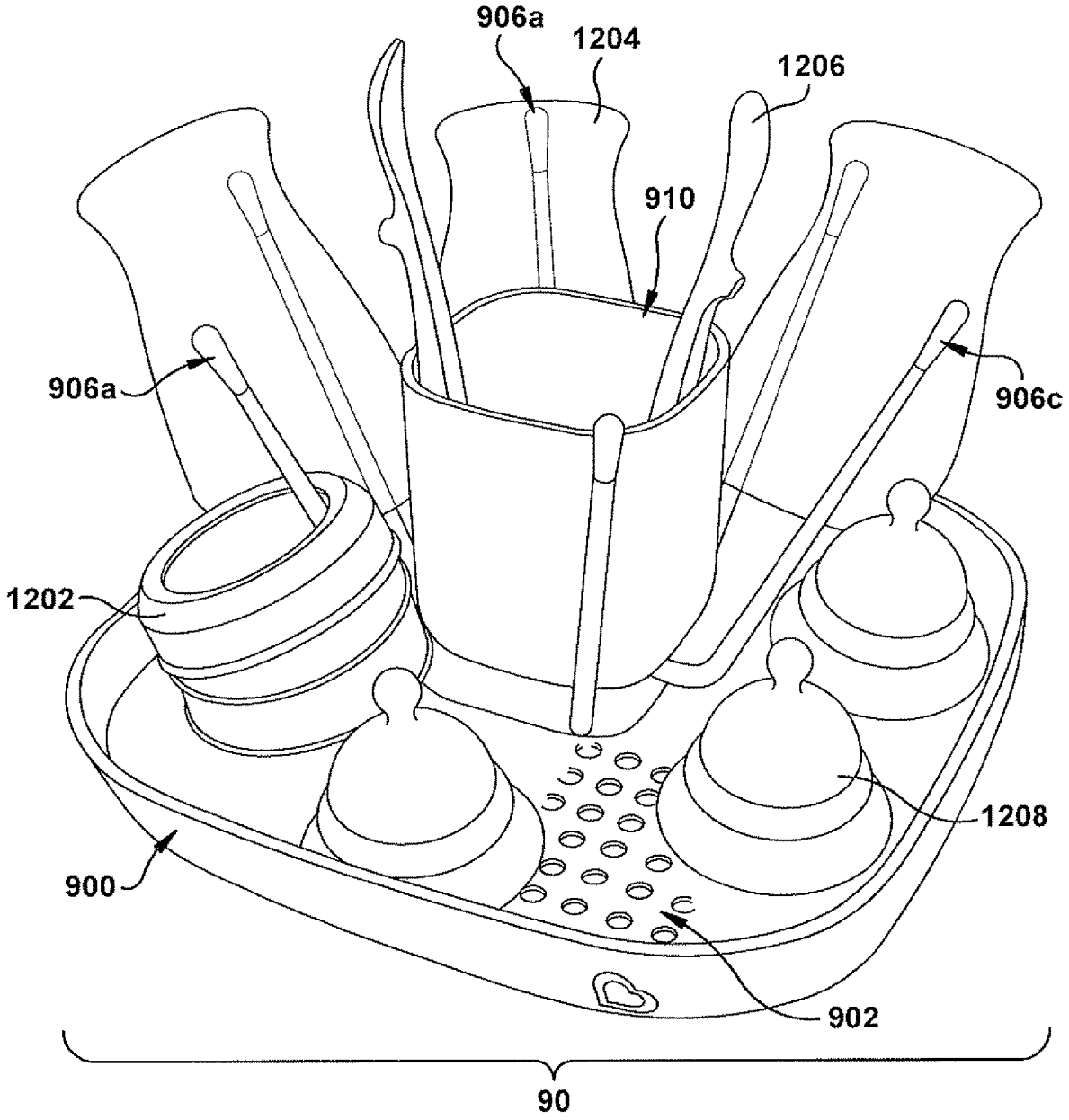
FIG. 12 illustrates yet another example schematic of a perspective view of a bottle rack in accordance with one or more embodiments described herein.

Referring now to FIG. 12, illustrated is an example schematic of a perspective view of the bottle rack 90 in accordance with one or more embodiments described herein. As shown in FIG. 12, the first modular peg 906*a* can support a first article 1202 (e.g., a baby bottle collar), the second modular peg 906*b* can support a second article 1204 (e.g., a baby bottle body), and the third modular peg 906*c* can be available to support another article. Additionally or alternatively, the base member 910 can retain a third article 1206 (e.g., an eating utensil) and/or the reservoir 900 (e.g., the perforated tray 902) can support a fourth article 1208 (e.g., a baby bottle nipple).

Figure 13:
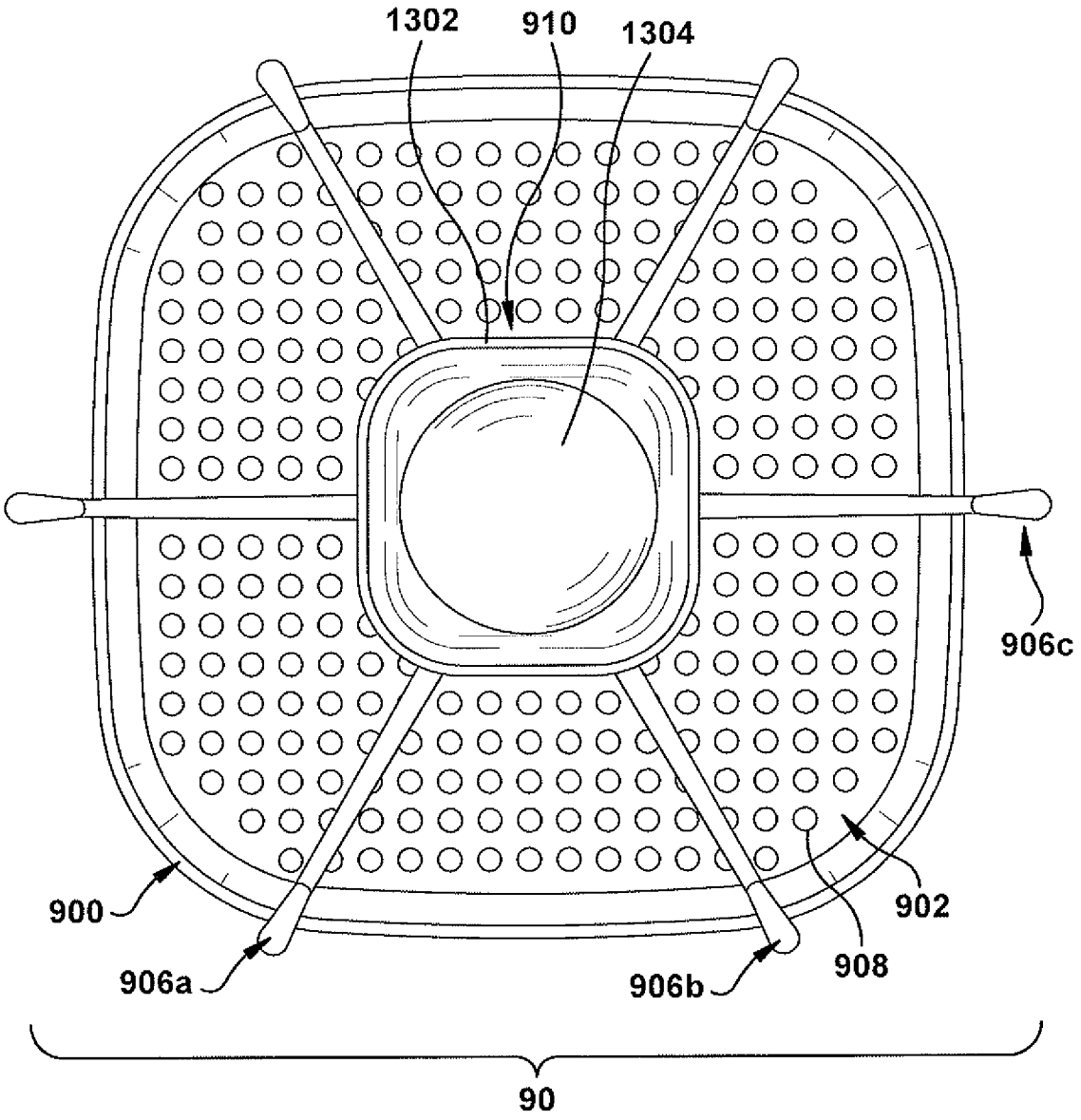
FIG. 13 illustrates an example schematic of a top view of a bottle rack in accordance with one or more embodiments described herein.

Referring now to FIG. 13, illustrated is an example schematic of a top view of the bottle rack 90 in accordance with one or more embodiments described herein. As shown in FIG. 13, the base member 910 can include a wall portion 1302 and a concave portion 1304. For example, the wall portion 1302 can comprise a defined depth to form the concave portion 1304. The concave portion 1304 can retain one or more articles such as, for example, the third article 1206.

Figure 14:
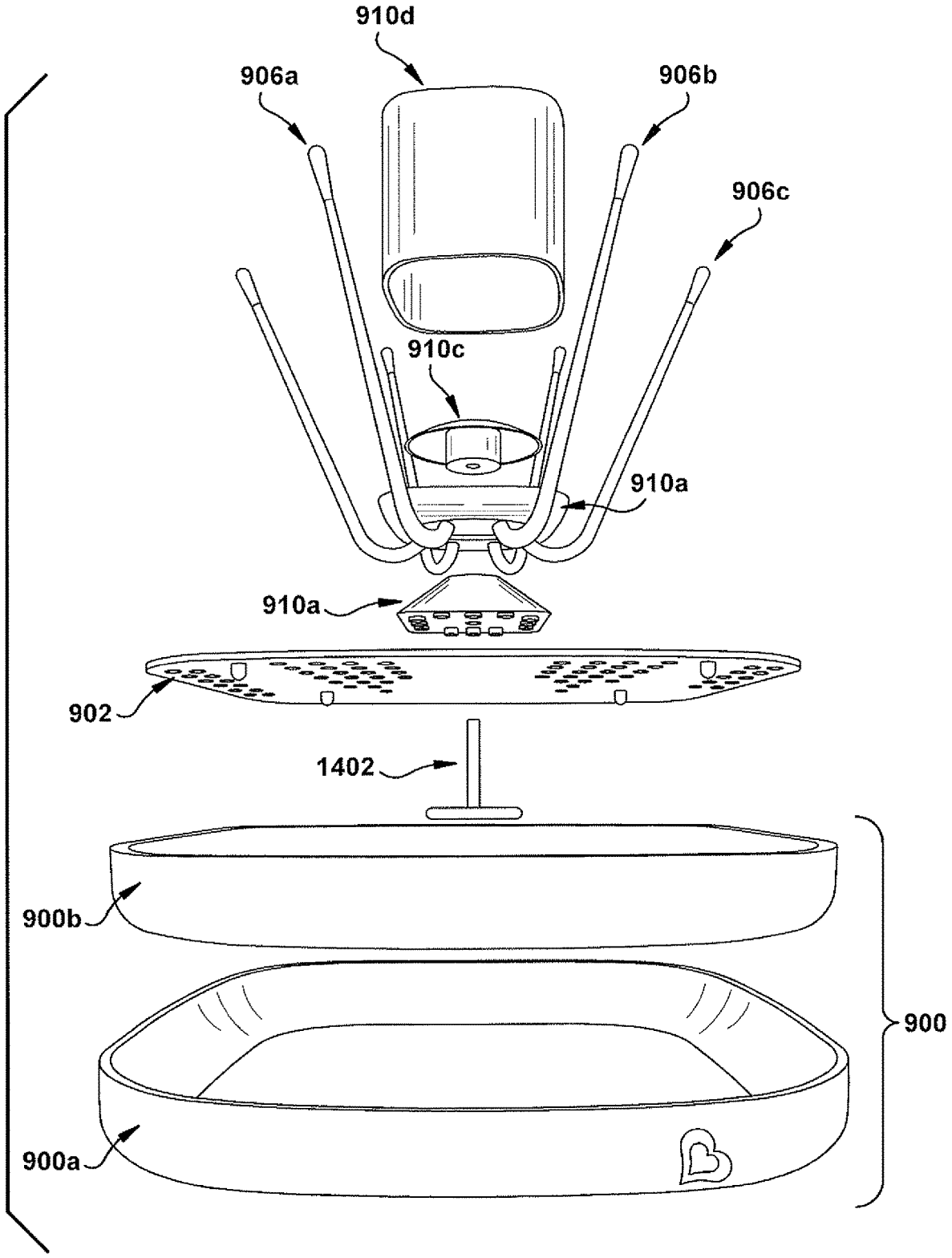
FIG. 14 illustrates an example schematic of an exploded view of a bottle rack in accordance with one or more embodiments described herein.

Referring now to FIG. 14, illustrated is an example schematic of an exploded view of the bottle rack 90 in accordance with one or more embodiments described herein. As shown in FIG. 14, the reservoir 900 can include a first portion 900*a* and second portion 900*b*. The second portion 900*b* of the reservoir 900 can fit within the first portion 900*a* of the reservoir 900. Furthermore, the second portion 900*b* of the reservoir 900 can be a liquid-holding reservoir portion of the reservoir 900. For instance, the second portion 900*b* of the reservoir 900 can be a liquid-holding reservoir portion that can retain a liquid transferred from one or more articles (e.g., one or more baby bottles) during a drying process associated with the one or more articles. The first portion 900*a* of the reservoir 900 can be a stabilizing member of the reservoir 900. For instance, the first portion 900*a* of the reservoir 900 can provide additional stability and/or support for other elements of the bottle rack 90. In an embodiment, the perforated tray 902 can be coupled to the base member 910 via a fastener element 1402. The fastener element 1402 can be, for example, a threaded fastener element where a threaded portion of the fastener element 1402 can fit through a mounting hole from the set of mounting holes 908. In an aspect, the perforated tray 902 can be coupled to a first base element 910*a* of the base member 910 via the fastener element 1402. For example, the fastener element 1402 can fit through a mounting hole from the set of mounting holes 908. Furthermore, the fastener element 1402 can fit through an opening of the first base element 910*a* of the base member 910. A second base element 910*b* of the base member 910 can also receive the fastener element 1402 via an opening of the second base element 910*b* of the base member 910. Furthermore, the fastener element 1402 can be fasted to a third base element 910*c* of the base member 910. A fourth base element 910*d* of the base member 910 can fit within the second base element 910*b* to form a concave portion to retain one or more objects. One or more modular pegs 906 (e.g., the first modular peg 906*a*, the second modular peg 906*b* and the third modular peg 906*c* can be attached to the second base element 910*b* of the base member 910. In a non-limiting example, the first portion 900*a* can be formed from a first material (e.g., a plastic material) and second portion 900*b* can be formed from a second material (e.g., stainless steel).

Figure 15:
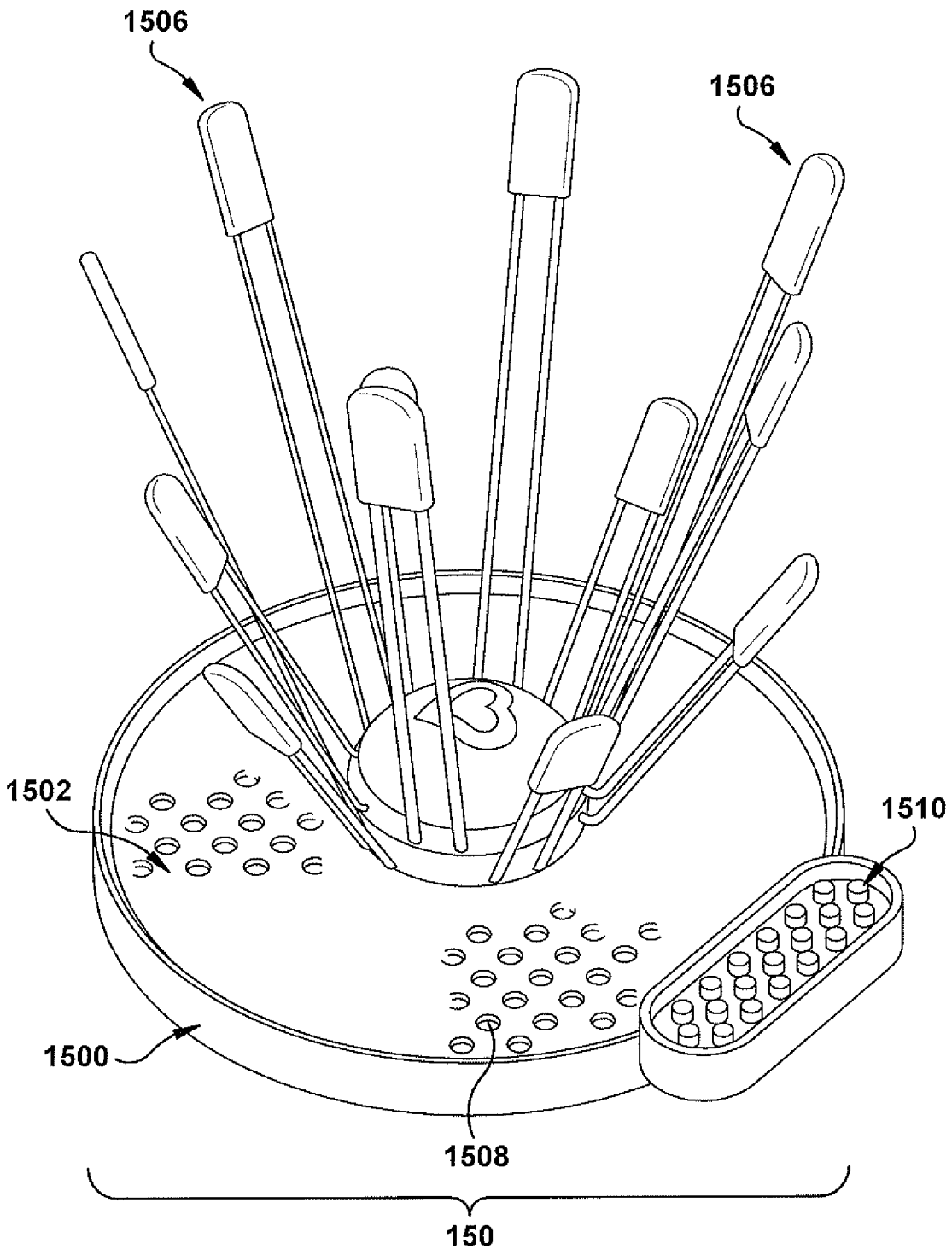
FIG. 15 illustrates an example schematic of a perspective view of a bottle rack in accordance with one or more embodiments described herein.

Referring now to FIG. 15, illustrated is an example schematic of a perspective view of a bottle rack 150 in accordance with one or more embodiments described herein. The bottle rack 150 can include a reservoir 1500. The reservoir 1500 can be formed as a container capable of being filled with a liquid. For instance, the reservoir 1500 can include a bottom surface and a set of wall surfaces configured to retain a fluid such as, for example, water or another fluid. The set of wall surfaces of the reservoir 1500 can be a defined height to retain a liquid. In one example, the reservoir 1500 that can retain a liquid transferred from one or more articles (e.g., one or more baby bottles) during a drying process associated with the one or more articles. For instance, a drying process can occur after washing and/or rinsing the one or more articles (e.g., one or more baby bottles).

In an aspect, the reservoir 1500 can retain a perforated tray 1502. The perforated tray 1502 can include a set of mounting holes 1508. The set of mounting holes 1508 can be a set of perforations that enable passage of liquid to the bottom surface of the reservoir 1500. One or more modular pegs 1506 can be attached to a surface of the perforated tray 1502. In an aspect, the one or more modular pegs 1506 can be employed to support one or more articles (e.g., one or more bottles) during a drying process associated with the one or more articles. In one example, the one or more modular pegs 1506 can be formed from plastic material. In another example, the one or more modular pegs 1506 can be formed from metal material. In an embodiment, the one or more modular pegs 1506 can be attachable and/or removable with respect to the perforated tray 1502. In certain embodiments, the bottle rack 150 can include an attachment element 1510. The attachment element 1510 can be attachable and/or removable with respect to a side of the reservoir 1500. In one example, the attachment element 1510 can be a side tray for the bottle rack 150.

Figure 16:
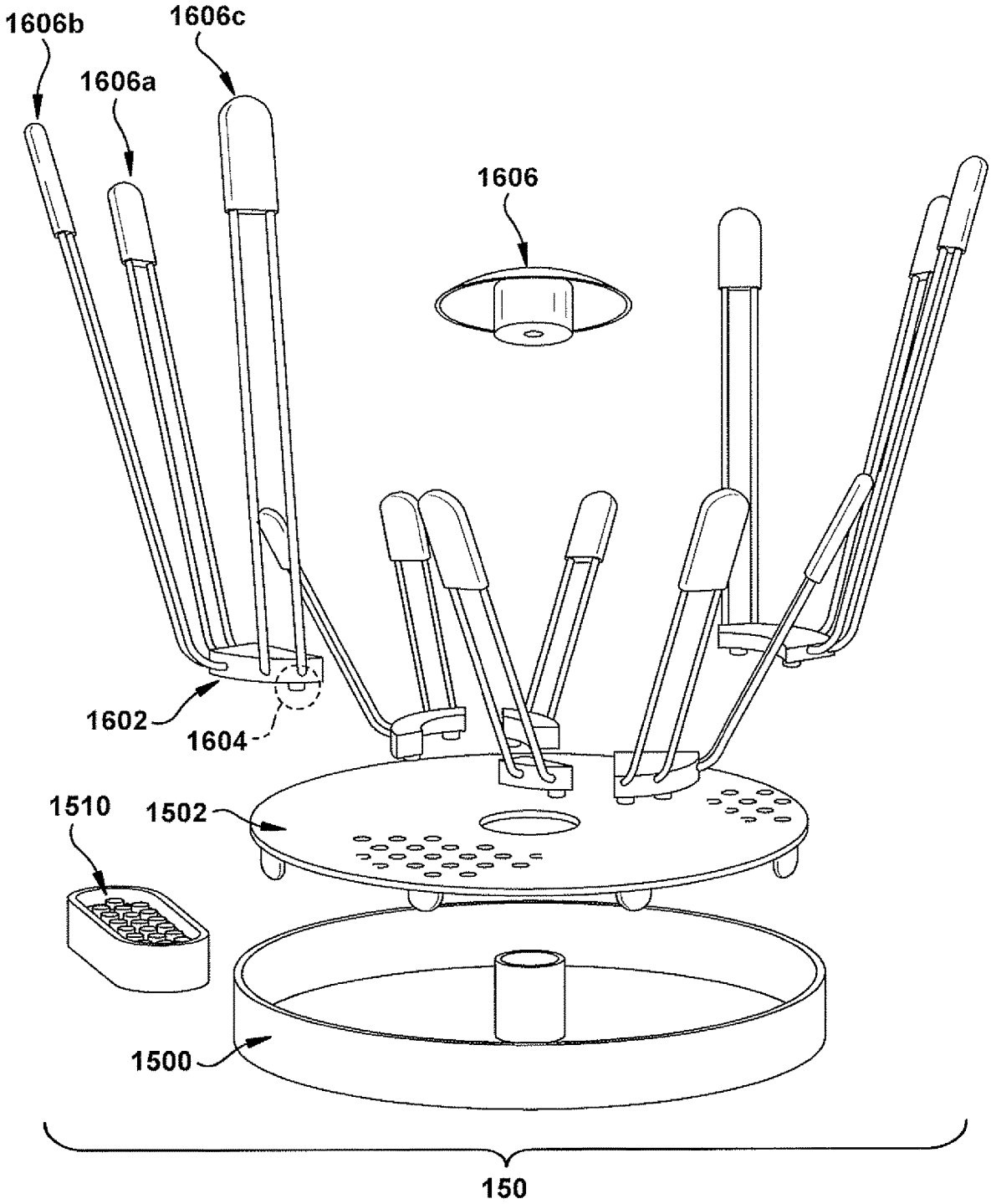
FIG. 16 illustrates an example schematic of an exploded view of a bottle rack in accordance with one or more embodiments described herein.

Referring now to FIG. 16, illustrated is an example schematic of an exploded view of the bottle rack 150 in accordance with one or more embodiments described herein. As shown in FIG. 16, the one or more modular pegs 1506 can be associated with a peg structure 1602. For instance, a first modular peg 1506*a*, a second modular peg 1506*b* and a third modular peg 1506*c* can be attached to a peg structure 1602. The peg structure 1602 can be attachable and/or removable with respect to the perforated tray 1502. In an embodiment, the peg structure 1602 can include one or more pegs 1604 configured to fit within the set of mounting holes 1508 of the perforated tray 1502. In one example, the peg structure 1602 can include three pegs 1604 configured to fit within three mounting holes from the set of mounting holes 1508 of the perforated tray 1502. In another embodiment, a cap structure 1606 can be configured to attach to the reservoir 1500. The cap structure 1606 can also fit over the peg structure 1602 and/or one or more other peg structures to facilitate securing the one or more modular pegs 1506 to the perforated tray 1502.

Figure 17:
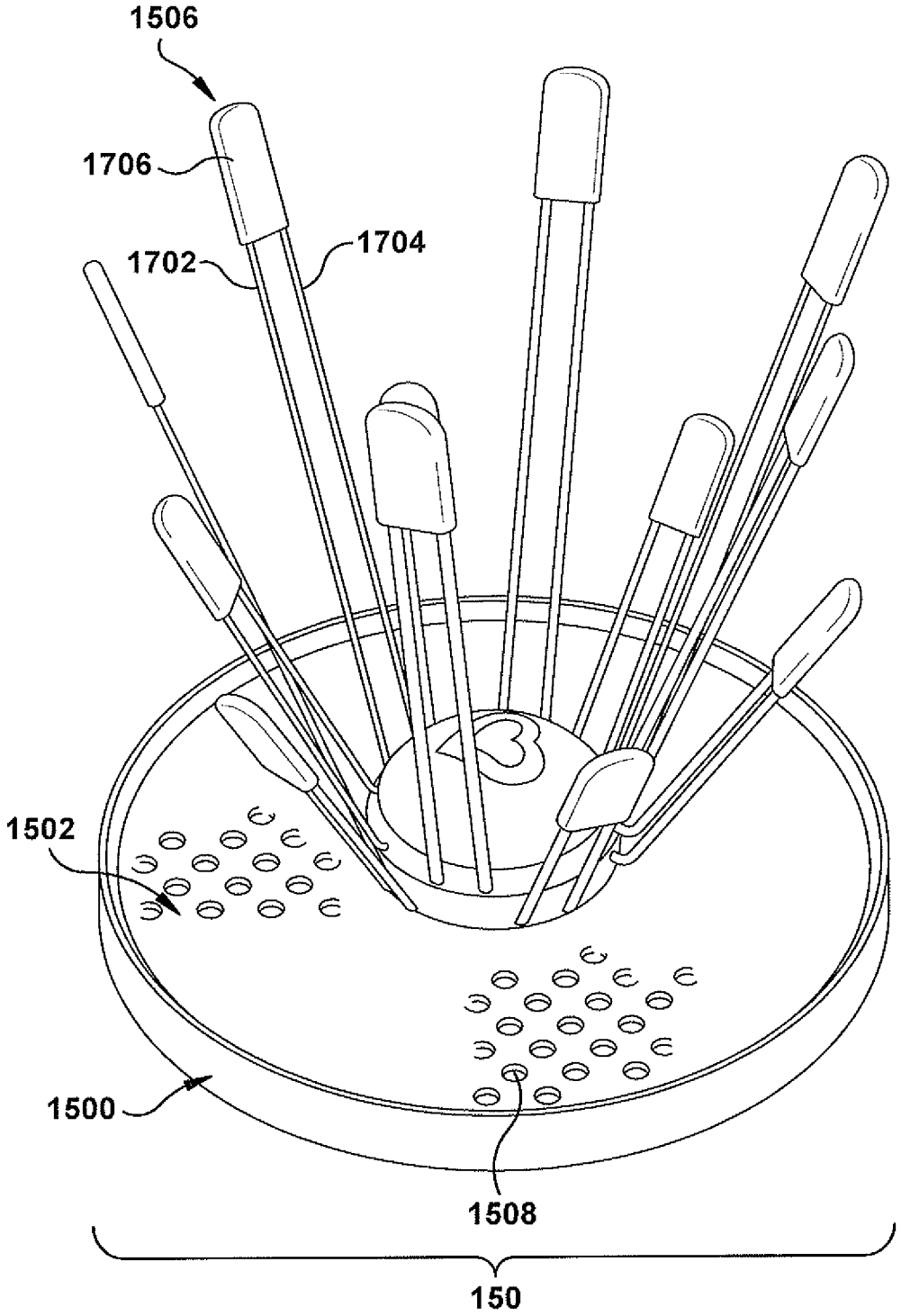
FIG. 17 illustrates an example schematic of a perspective view of a bottle rack in accordance with one or more embodiments described herein.

Referring now to FIG. 17, illustrated is an example schematic of a perspective view of the bottle rack 150 in accordance with one or more embodiments described herein. As shown in FIG. 17, a modular peg 1506 can include a first peg 1702 and a second peg 1704. The first peg 1702 and the second peg 1704 can be coupled by a cap element 1706. For instance, the first peg 1702 and the second peg 1704 can be metal pegs and the cap element 1706 can be a plastic cap that is attached to the first peg 1702 and the second peg 1704. In an embodiment, the first peg 1702 and the second peg 1704 can be associated with a single wire structure that is bent to form a semicircle shape with the extensions corresponding to the first peg 1702 and the second peg 1704.

Figure 18:
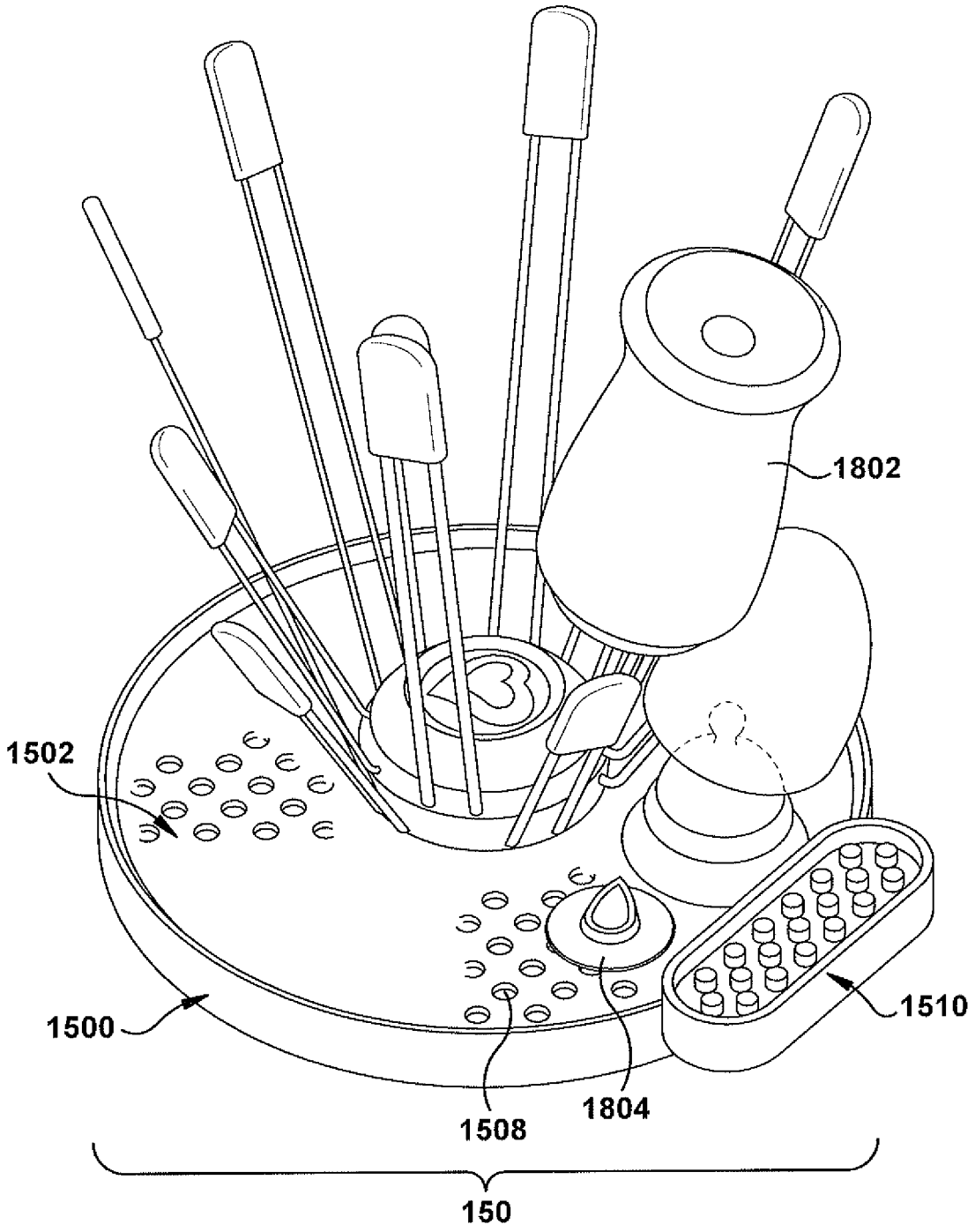
FIG. 18 illustrates another example schematic of a perspective view of a bottle rack in accordance with one or more embodiments described herein.

Referring now to FIG. 18, illustrated is an example schematic of a perspective view of a bottle rack 150 in accordance with one or more embodiments described herein. As shown in FIG. 18, a modular peg of the bottle rack 150 can support a first article 1802 (e.g., a baby bottle body). Additionally or alternatively, the reservoir 1500 (e.g., the perforated tray 1502) can support a second article 1804 (e.g., a baby bottle nipple).

Figure 19:
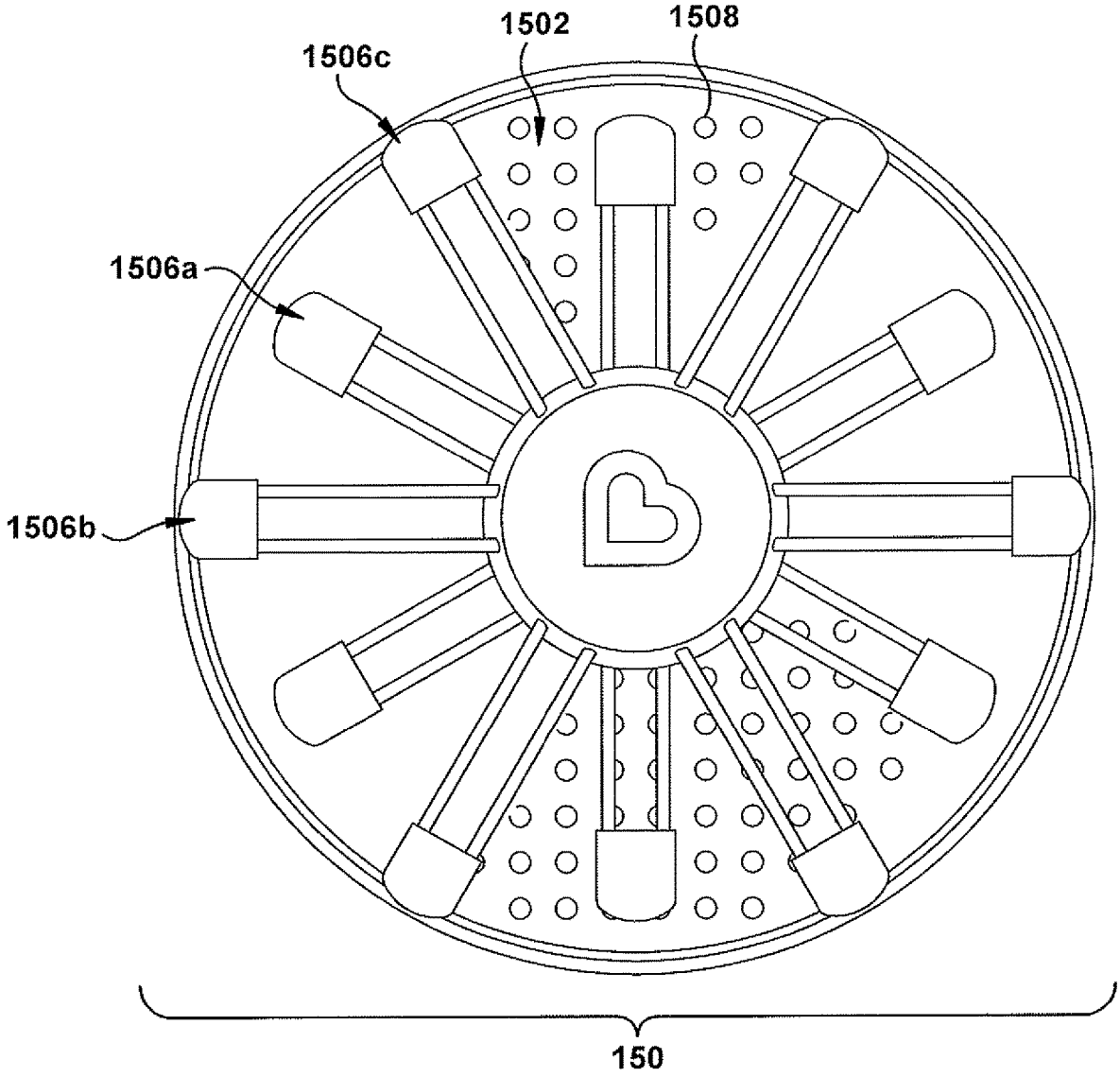
FIG. 19 illustrates an example schematic of a top view of a bottle rack in accordance with one or more embodiments described herein.

Referring now to FIG. 19, illustrated is an example schematic of a top view of a bottle rack 150 in accordance with one or more embodiments described herein. As seen in FIG. 19, one or more modular pegs 1506 of the bottle rack 150 can comprise a different height than one or more other modular pegs 1506 of the bottle rack 150. For example, the first modular peg 1506*a* and the third modular peg 1506*c* can comprise a corresponding height. Furthermore, the second modular peg 1506*b* can comprise a height that is different than a height associated with the first modular peg 1506*a* and the third modular peg 1506*c*. For instance, the first modular peg 1506*a* and the third modular peg 1506*c* can comprise a first height. Furthermore, the second modular peg 1506*b* can comprise a second height. In one example, the second height associated with the second modular peg 1506*b* can be less than the first height associated with the first modular peg 1506*a* and the third modular peg 1506*c*. In another example, the second height associated with the second modular peg 1506*b* can be less than the first height associated with the first modular peg 1506*a* and the third modular peg 1506*c*.

Figure 20:
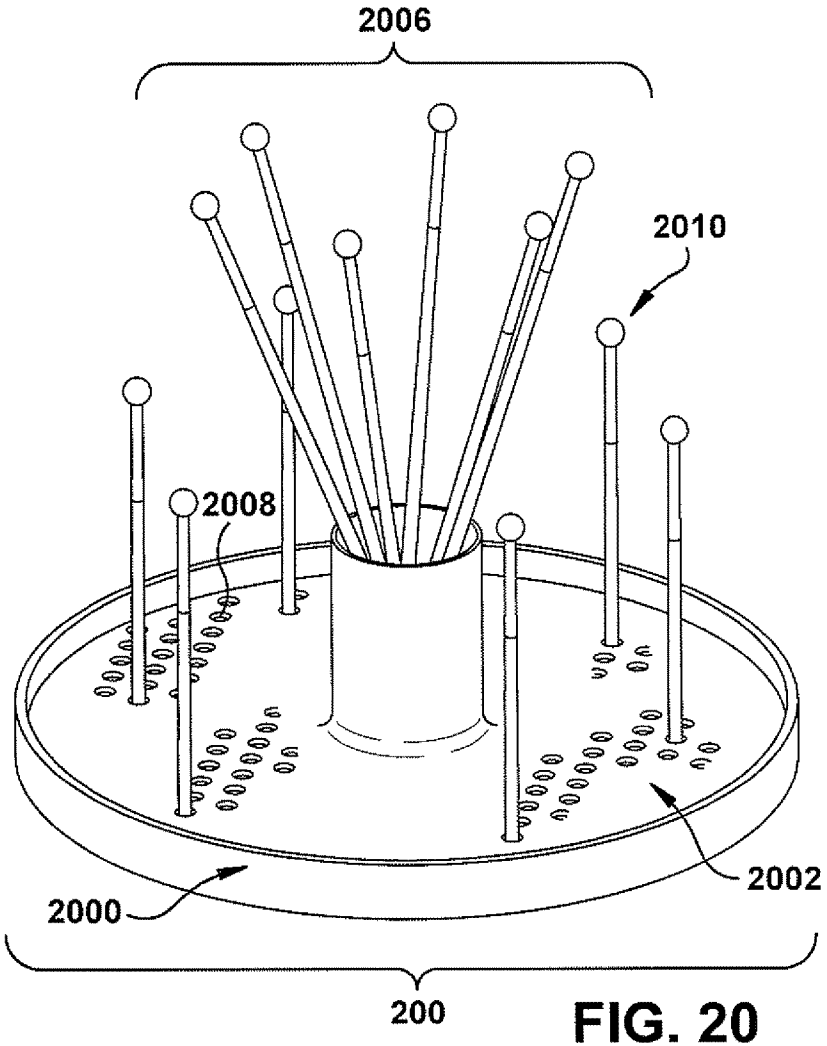
FIG. 20 illustrates an example schematic of a perspective view of a bottle rack in accordance with one or more embodiments described herein.

Referring now to FIG. 20, illustrated is an example schematic of a perspective view of a bottle rack 200 in accordance with one or more embodiments described herein. The bottle rack 200 can include a reservoir 2000. The reservoir 2000 can be formed as a container capable of being filled with a liquid. For instance, the reservoir 2000 can include a bottom surface and a set of wall surfaces configured to retain a fluid such as, for example, water or another fluid. The set of wall surfaces of the reservoir 2000 can be a defined height to retain a liquid. In one example, the reservoir 2000 that can retain a liquid transferred from one or more articles (e.g., one or more baby bottles) during a drying process associated with the one or more articles. For instance, a drying process can occur after washing and/or rinsing the one or more articles (e.g., one or more baby bottles).

In an aspect, the reservoir 2000 can retain a perforated tray 2002. The perforated tray 2002 can include a set of mounting holes 2008. The set of mounting holes 2008 can be a set of perforations that enable passage of liquid to the bottom surface of the reservoir 2000. In another aspect, the bottle rack 200 can include a set of modular pegs 2006. The set of modular pegs 2006 can be employed to support one or more articles (e.g., one or more bottles) during a drying process associated with the one or more articles. An orientation of the set of modular pegs 2006 can be altered. For example, in an embodiment shown in FIG. 20, the set of modular pegs 2006 can be in an open position. In one example, the set of modular pegs 2006 can be formed from plastic material. In another example, the set of modular pegs 2006 can be formed from metal material. In certain embodiments, the bottle rack 200 can include one or more modular pegs 2010. A shape and/or a size of the one or more modular pegs 2010 can correspond to a shape and/or a size of a mounting hole from the set of mounting holes 2008. In an aspect, the one or more modular pegs 2010 can be attachable and/or removable with respect to the perforated tray 902. For instance, the one or more modular pegs 2010 can be configured to fit within the set of mounting holes 908 of the perforated tray 902. In one example, the one or more modular pegs 2010 can be formed from plastic material. In another example, the one or more modular pegs 2010 can be formed from metal material.

Figure 21:
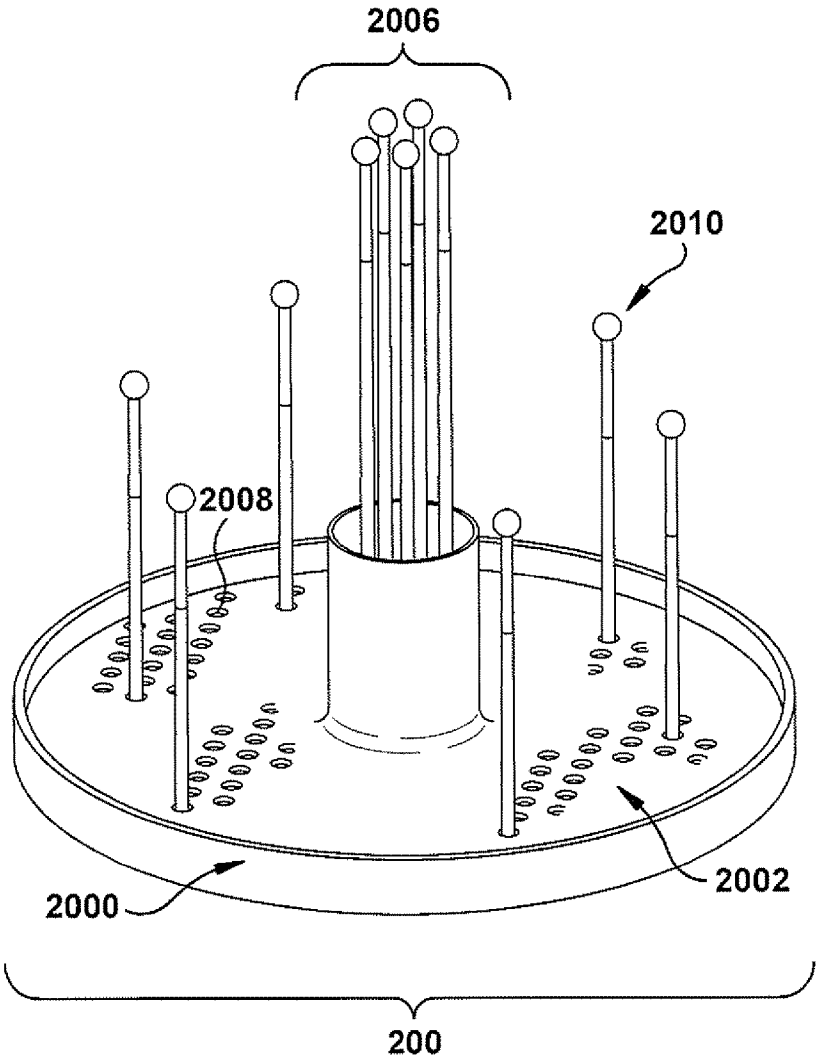
FIG. 21 illustrates another example schematic of a perspective view of a bottle rack in accordance with one or more embodiments described herein.

Referring now to FIG. 21, illustrated is an example schematic of a perspective view of a bottle rack 200 in accordance with one or more embodiments described herein. In an embodiment shown in FIG. 21, the set of modular pegs 2006 can be in a closed position. For example, the set of modular pegs 2006 can be modified from the open position shown in FIG. 20 to the closed position shown in FIG. 21.

Figure 22:
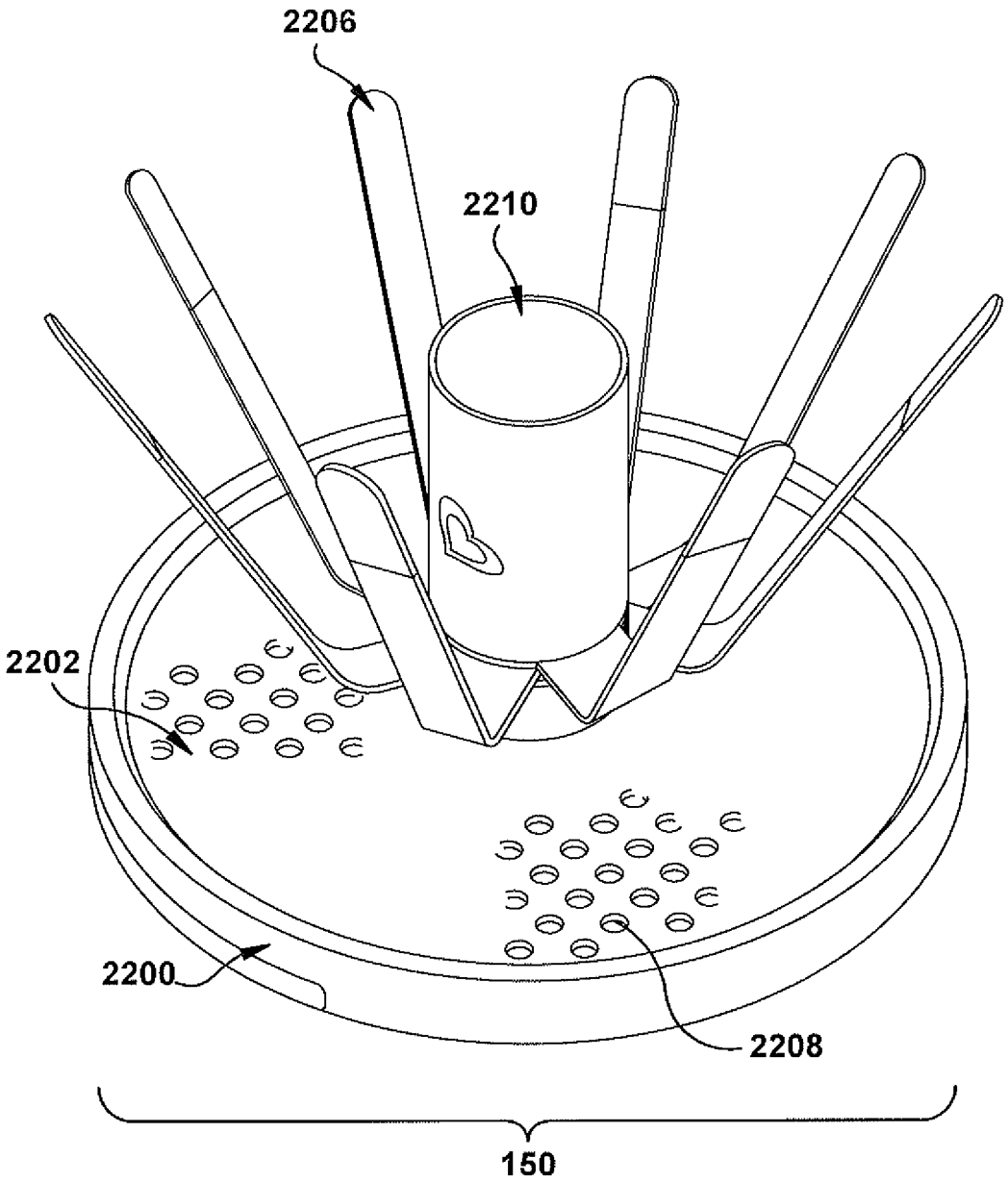
FIG. 22 illustrates yet another example schematic of a perspective view of a bottle rack in accordance with one or more embodiments described herein.

Referring now to FIG. 22, illustrated is an example schematic of a perspective view of a bottle rack 220 in accordance with one or more embodiments described herein. The bottle rack 220 can include a reservoir 2200. The reservoir 2200 can be formed as a container capable of being filled with a liquid. For instance, the reservoir 2200 can include a bottom surface and a set of wall surfaces configured to retain a fluid such as, for example, water or another fluid. The set of wall surfaces of the reservoir 2200 can be a defined height to retain a liquid. In one example, the reservoir 2200 that can retain a liquid transferred from one or more articles (e.g., one or more baby bottles) during a drying process associated with the one or more articles. For instance, a drying process can occur after washing and/or rinsing the one or more articles (e.g., one or more baby bottles).

In an aspect, the reservoir 2200 can retain a perforated tray 2202. The perforated tray 2202 can include a set of mounting holes 2208. The set of mounting holes 2208 can be a set of perforations that enable passage of liquid to the bottom surface of the reservoir 2200. One or more modular pegs 2206 can be attached to a center member 2210. The one or more modular pegs 2206 can be employed to support one or more articles (e.g., one or more bottles) during a drying process associated with the one or more articles. In one example, the one or more modular pegs 2206 can be formed from plastic material. In another example, the one or more modular pegs 2206 can be formed from metal material. In an embodiment, the one or more modular pegs 2206 can be rotatable with respect to the center member 2210. In an aspect, a width of the or more modular pegs 2206 can be larger than a thickness of the or more modular pegs 2206

Figure 23:
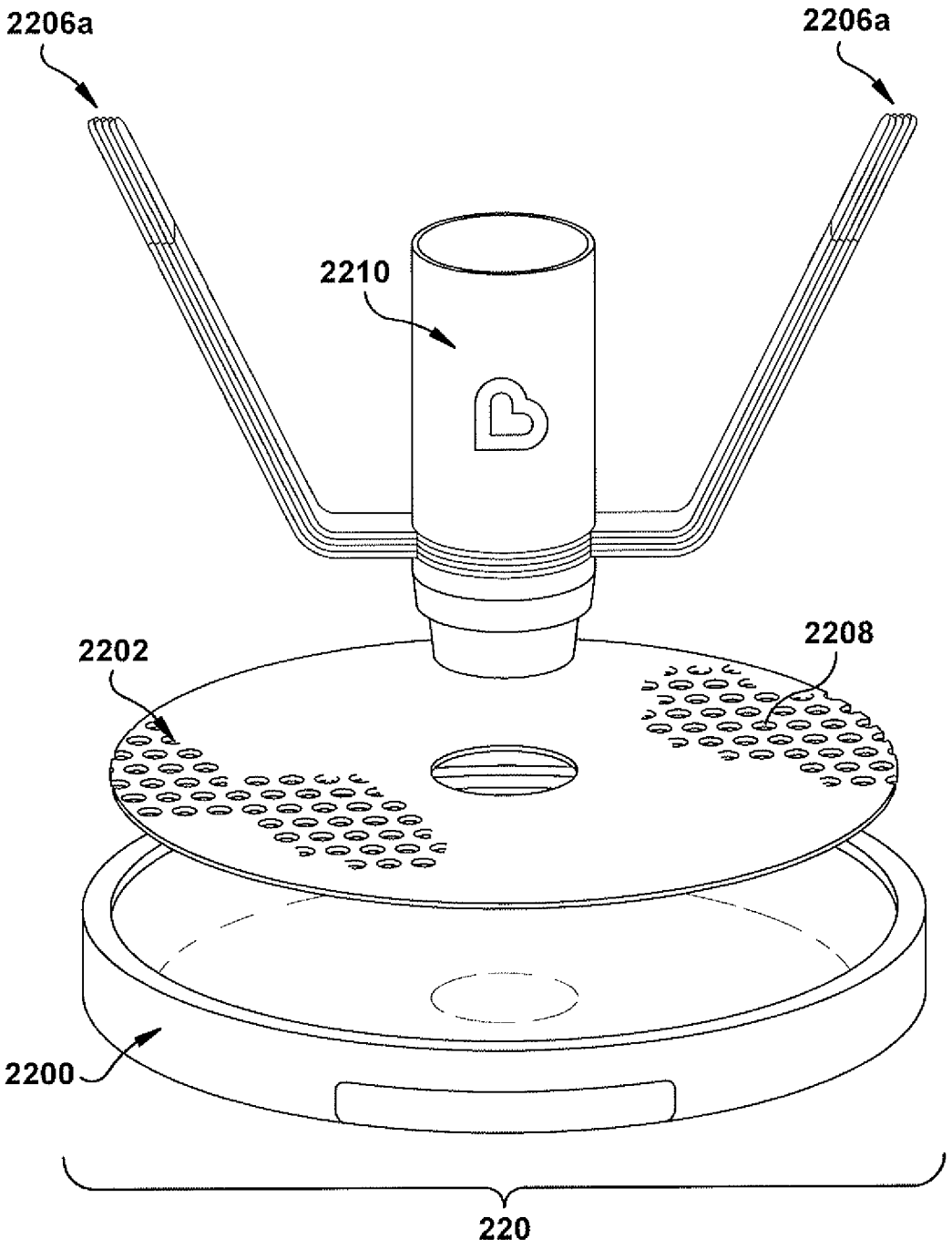
FIG. 23 illustrates an example schematic of an exploded view of a bottle rack in accordance with one or more embodiments described herein.

Referring now to FIG. 23, illustrated is an example schematic of an exploded view of the bottle rack 220 in accordance with one or more embodiments described herein. As shown in FIG. 23 the one or more modular pegs 2206 can be rotatable with respect to the center member 2210. For instance, the one or more modular pegs 2206 can be rotated with respect to the center member 2210 to form at least a first group of modular pegs 2206*a* and a second group of modular pegs 2206*b*. The first group of modular pegs 2206*a* and/or the second group of modular pegs 2206*b* can include two or more modular pegs. For example, the first group of modular pegs 2206*a* can include four modular pegs and the second group of modular pegs 2206*b* can include four other modular pegs. In another example, the first group of modular pegs 2206*a* can include six modular pegs and the second group of modular pegs 2206*b* can include two other modular pegs. However, it is to be appreciated that the first group of modular pegs 2206*a* and/or the second group of modular pegs 2206*b* can include a different number of modular pegs.

Figure 24:
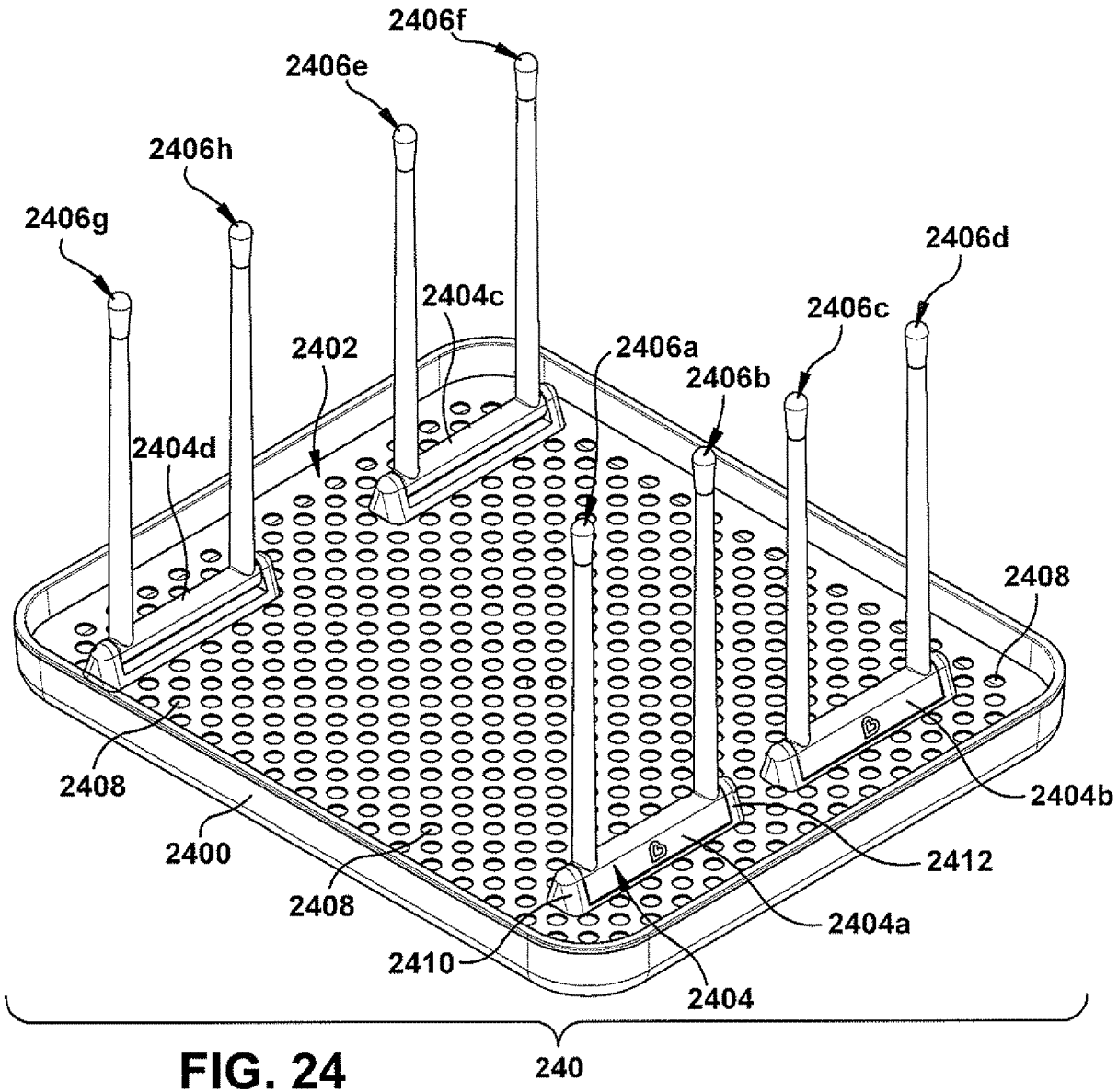
FIG. 24 illustrates yet another example schematic of a perspective view of a bottle rack comprising modular pegs in accordance with one or more embodiments described herein.

Referring now to FIG. 24, illustrated is an example schematic of a perspective view of a bottle rack 240 in accordance with one or more embodiments described herein. The bottle rack 240 can be, for example, a modular bottle rack that comprises a set of parts that together form the bottle rack 240. In one example, the bottle rack 240 can be a drying rack. The bottle rack 240 can include a reservoir 2400. The reservoir 2400 can be formed as a container capable of being filled with a liquid. For instance, the reservoir 2400 can include a bottom surface and a set of wall surfaces configured to retain a fluid such as, for example, water or another fluid. The set of wall surfaces of the reservoir 2400 can be a defined height to retain a liquid. In one example, the reservoir 2400 that can retain a liquid transferred from one or more articles during a drying process associated with the one or more articles. For instance, a drying process can occur after washing and/or rinsing the one or more articles. In another example, the reservoir 2400 can be a drip tray for one or more articles associated with the drying process. An article can include, for example, an item or an object such as a baby bottle, a baby bottle body, a baby bottle nipple, a baby bottle collar, a baby bottle ring, a baby bottle hood, a baby bottle disk, a baby bottle accessory, a pump accessory, a cup, tableware, a snacking container, or another type of article.

In an embodiment, the reservoir 2400 can retain a perforated tray 2402. The perforated tray 2402 can include a set of mounting holes 2408. The set of mounting holes 2408 can be a set of perforations that enable passage of liquid to the bottom surface of the reservoir 2400. One or more pivot housings 2404 can be formed on a surface of the perforated tray 2402. For instance, a pivot housing 2404*a*, a pivot housing 2404*b*, a pivot housing 2404*c* and/or a pivot housing 2404*d* can be formed on a surface of the perforated tray 2402. A pivot housing 2404 can include a set of modular pegs 2406. The set of modular pegs 2406 can be, for example, drying pegs (e.g., moveable drying pegs). A pivot housing 2404 can also comprise a rotating axle to enable one or more modular pegs 2406 to freely rotate about the rotating axle of the pivot housing 2404. For instance, a pivot housing 2404 can be a structure (e.g., a pivot housing member, a modular pivot housing member, etc.) that can comprise a rotating axle that enables one or more modular pegs 2406 to rotate up to an orientation approximately perpendicular to a surface of the perforated tray 2402 (e.g., enable one or more modular pegs 2406 to be in an upright position) and/or down to an orientation approximately parallel to a surface of the perforated tray 2402 (e.g., enable one or more modular pegs 2406 to be in a semi-compacted position). In one example embodiment, the pivot housing 2404*a* can include a modular peg 2406*a* and a modular peg 2406*b*, the pivot housing 2404*b* can include a modular peg 2406*c* and a modular peg 2406*d*, the pivot housing 2404*c* can include a modular peg 2406*e* and a modular peg 2406*f*, and the pivot housing 2404*d* can include a modular peg 2406*g* and a modular peg

2406*h*. The modular peg 2406*a* and the modular peg 2406*b* can be extensions from the pivot housing 2404*a* such that rotation of the pivot housing 2404*a* can result in rotation of the modular peg 2406*a* and the second modular peg 2406*b*, the modular peg 2406*c* and the modular peg 2406*d* can be extensions from the pivot housing 2404*b* such that rotation of the pivot housing 2404*b* can result in rotation of the modular peg 2406*c* and the second modular peg 2406*d*, the modular peg 2406*e* and the modular peg 2406*f* can be extensions from the pivot housing 2404*c* such that rotation of the pivot housing 2404*c* can result in rotation of the modular peg 2406*e* and the second modular peg 2406*f*, modular peg 2406*g* and the modular peg 2406*h* can be extensions from the pivot housing 2404*d* such that rotation of the pivot housing 2404*d* can result in rotation of the modular peg 2406*g* and the second modular peg 2406*h*. In an aspect, the modular pegs 2406*a-h* can be employed to support one or more articles during a drying process associated with the one or more articles. In an embodiment, the pivot housings 2404*a-d* can comprise fixed end portions. For instance, the pivot housing 2404*a* can comprise a first fixed end portion 2410 and a second fixed end portion 2412. A portion of the rotating axle of the pivot housing 2404*a* can extend into the first fixed end portion 2410 and the second fixed end portion 2412 such that the portion the rotating axle of the pivot housing 2404*a* can rotate within the first fixed end portion 2410 and the second fixed end portion 2412. In another embodiment, the pivot housings 2404*a-d* can be attachable and/or removable with respect to the perforated tray 2402. For instance, the pivot housings 2404*a-d* can include a set of pegs configured to fit within the set of mounting holes 2408 of the perforated tray 2402. In one example, the modular pegs 2406*a-h* can be formed from plastic material. In another example, the modular pegs 2406*a-h* can be formed from metal material. In a non-limiting example, the reservoir 2400 can be formed from a plastic material and/or stainless-steel, the perforated tray 2402 can be formed from stainless steel, and the modular pegs 2406*a-h* can be formed from a plastic material.

Figure 25:
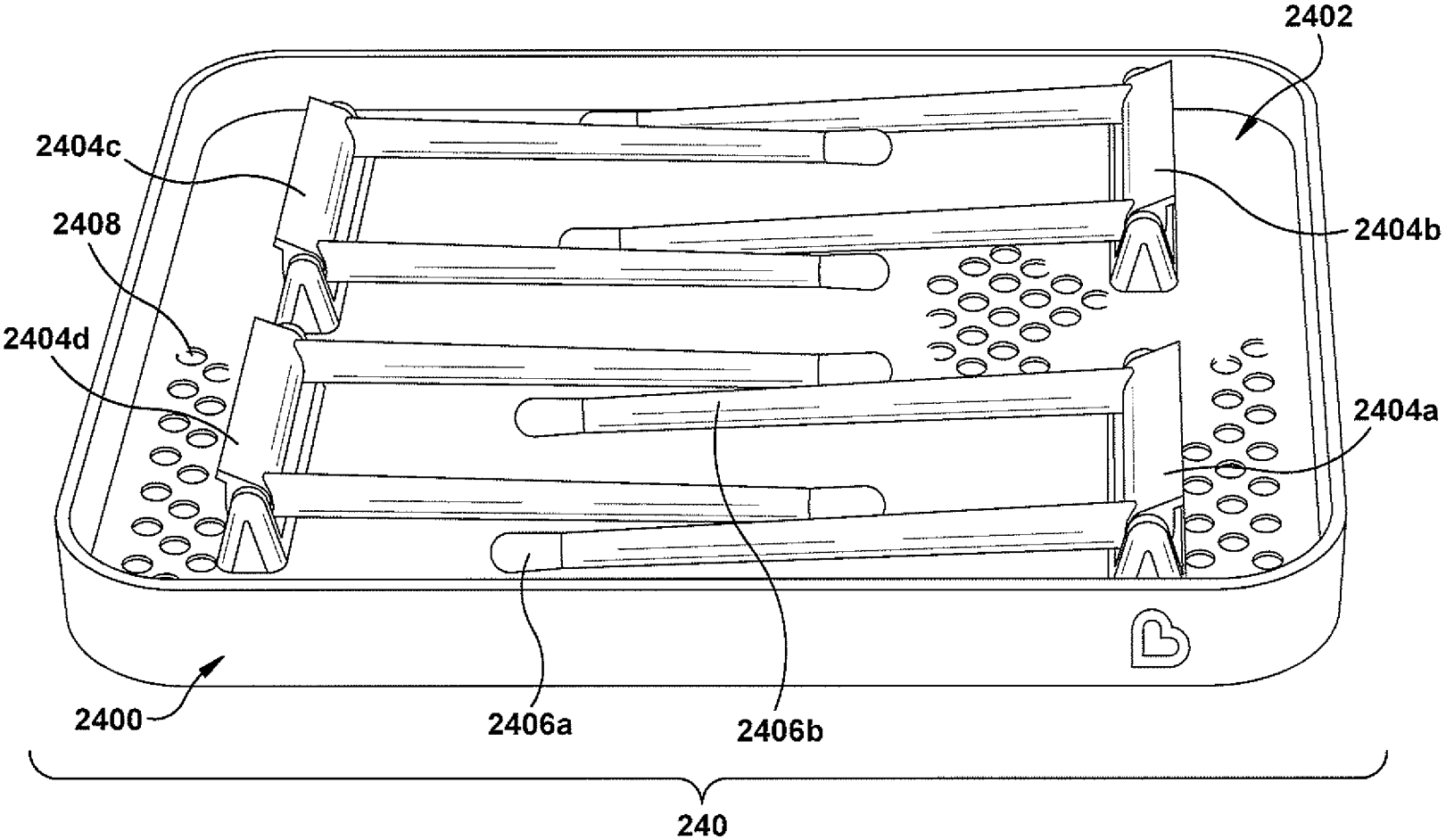
FIG. 25 illustrates yet another example schematic of a perspective view of a bottle rack comprising modular pegs in a semi-compacted position in accordance with one or more embodiments described herein.

Referring now to FIG. 25, illustrated is another example schematic of a perspective view of the bottle rack 240 in accordance with one or more embodiments described herein. In FIG. 25, the pivot housing 2404*a-d* of the bottle rack 240 can be rotated to enable modular pegs 2406*a-h* to rotate down to an orientation approximately parallel to a surface of the perforated tray 2402 (e.g., enable one or more modular pegs 2406*a-h* to be in a semi-compacted position). For example, the pivot housing 2404*a* can be rotated to enable at least the modular peg 2406*a* and the modular peg 2406*b* to be rotated down to an orientation approximately parallel to a surface of the perforated tray 2402 (e.g., the modular peg 2406*a* and the modular peg 2406*b* can be in a semi-compacted position). As such, modular pegs 2406*a-h* of the bottle rack 240 can be moveable with respect to a surface of the perforated tray 2402. In one example, a configuration of the bottle rack 240 shown in FIG. 25 can be employed for storage of the bottle rack 240 and/or travelling with the bottle rack 240 due to the reduced space utilized by the bottle rack 240.

Figure 26:
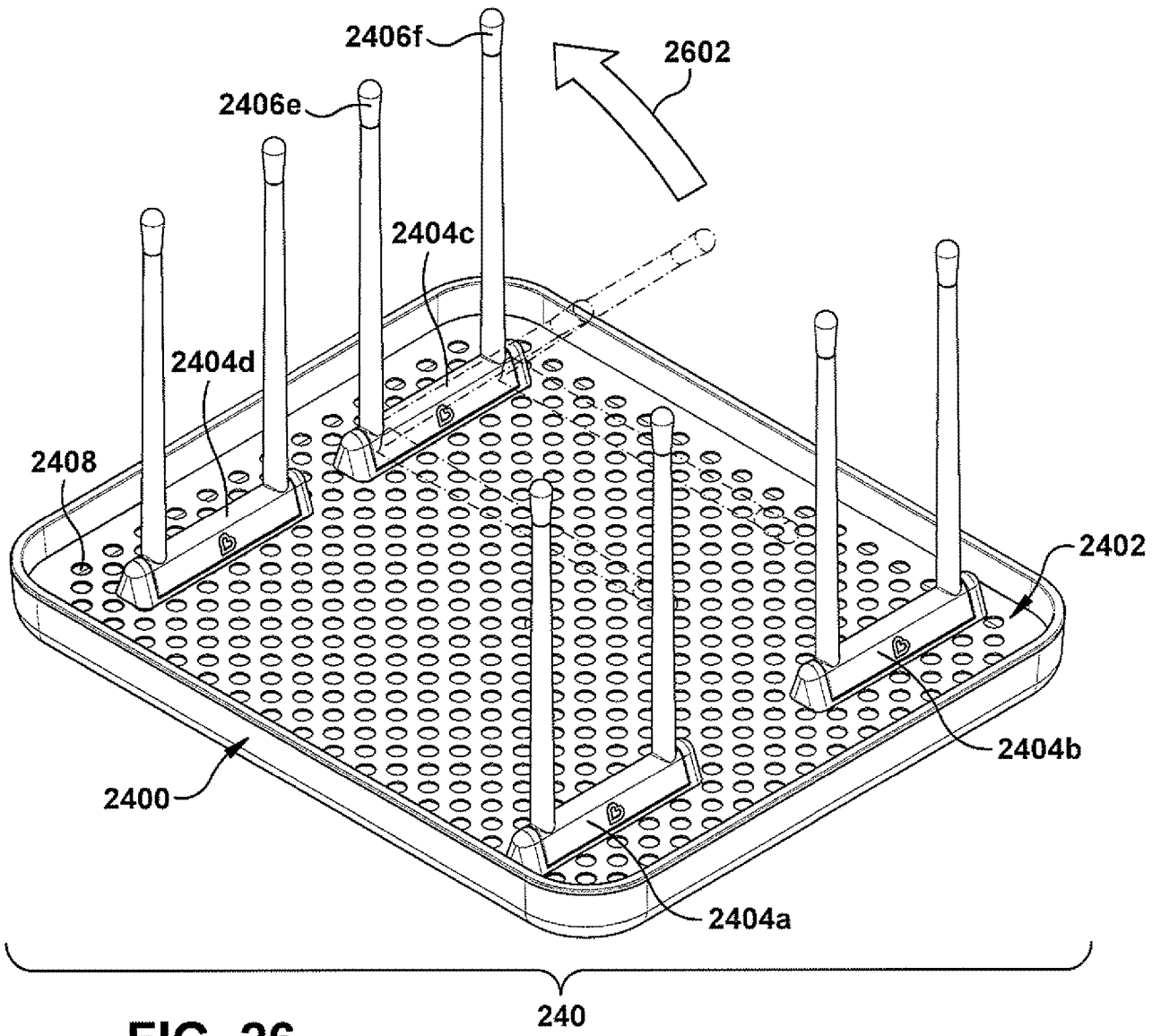
FIG. 26 illustrates yet another example schematic of a perspective view of a bottle rack comprising modular pegs in transition from a compacted position to an upright position in accordance with one or more embodiments described herein.

Referring now to FIG. 26, illustrated is yet another example schematic of a perspective view of the bottle rack 240 in accordance with one or more embodiments described herein. In FIG. 26, a pivot housing 2404 of the bottle rack 240 can be rotated to enable one or more modular pegs 2406 to rotate up to an orientation approximately perpendicular to a surface of the perforated tray 2402 (e.g., enable one or more modular pegs 2406 to be in a semi-compacted position). For instance, the modular peg 2406*e* and the modular peg 2406*f* can be movable between a first position (e.g. a storage position where the modular peg 2406*e* and the modular peg 2406*f* are approximately parallel to a surface of the perforated tray 2402) and a second position (e.g., an operative position where the modular peg 2406*e* and the modular peg 2406*f* are approximately perpendicular to a surface of the perforated tray 2402). In one example, the modular peg 2406*e* and the modular peg 2406*f* can be rotated up to an orientation approximately perpendicular to a surface of the perforated tray 2402 via a motion process 2602 (e.g., the modular peg 2406*e* and the modular peg 2406*f* can be in an upright position). The motion process 2602 can involve, for example, swinging the modular peg 2406*e* and the modular peg 2406*f* by rotating the pivot housing 2404*c*. In one example, a configuration of the bottle rack 240 shown in FIG. 26 can be employed during a drying process for one or more articles placed on the bottle rack 240. It is to be appreciated that although the bottle rack 240 can be employed while one or more modular pegs 2406 are in a fully upright position, the bottle rack 240 can also be employed during any transitional point from FIG. 25 to FIG. 26 due to friction. Alternatively, one or more of the modular pegs 2406*a-h* can incorporate a locking assembly between a lower end of one of the modular pegs 2406*a-h*, within a corresponding pivot housing 2404. For example, a pivot housing 2404 can include a cam surface that locks one or more modular pegs 2406*a-h* into a fully upright position. It is to be appreciated that various other locking assembly configurations are possible such as, for example, employing a snap lock configuration having a protrusion that locks into a recess, or the like. (See FIGS. 33, 34 and 35).

Figure 27:
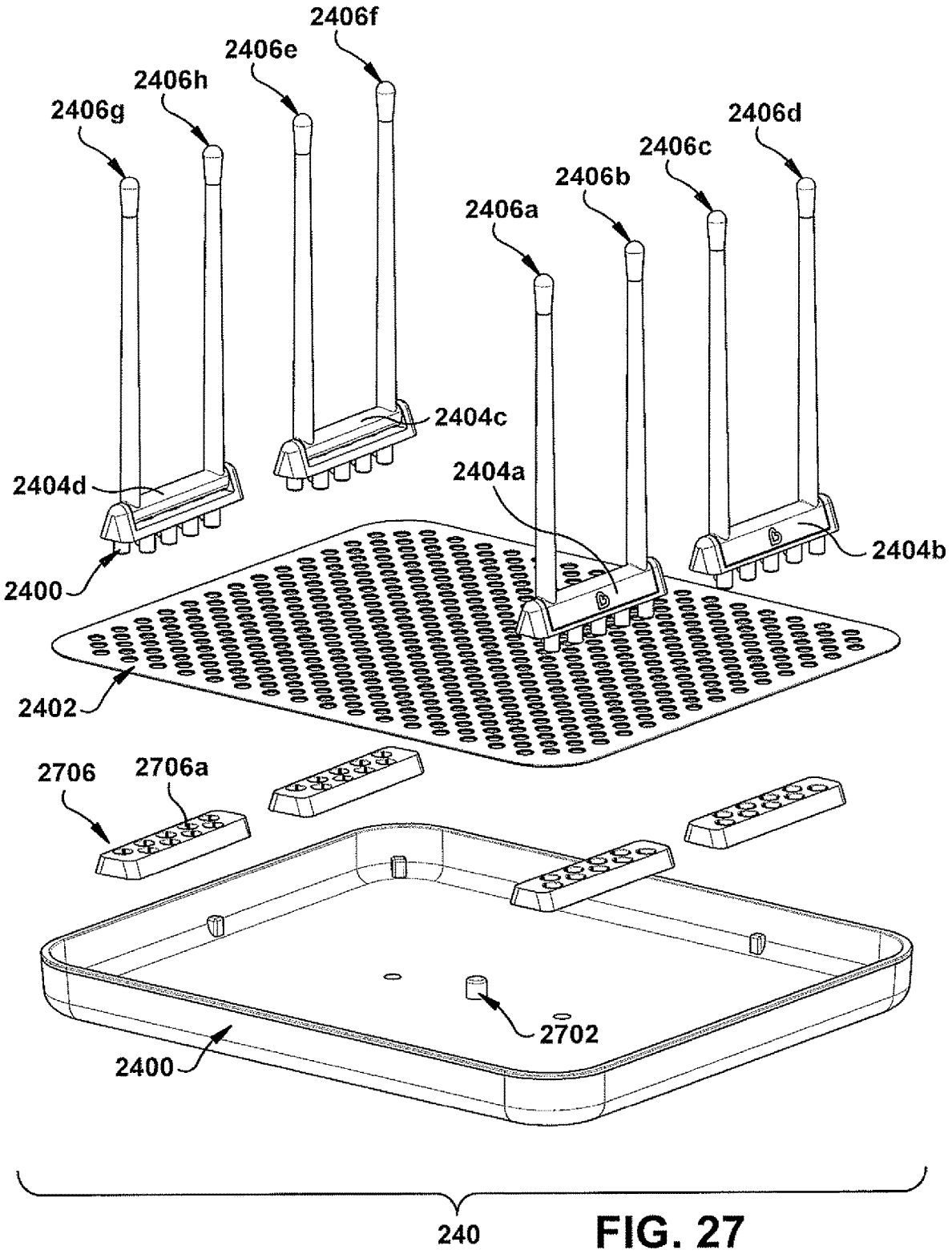
FIG. 27 illustrates yet another example schematic of an exploded view of a bottle rack in accordance with one or more embodiments described herein.

Referring now to FIG. 27, illustrated is an example exploded view of the bottle rack 240 in accordance with one or more embodiments described herein. The reservoir 2400 of the bottle rack 240 can include various structures to facilitate attachment of the perforated tray 2402 to the reservoir 2400. In an embodiment, the reservoir 2400 can include one or more posts 2702. The one or more posts 2702 can be employed to elevate the perforated tray 2402 above the reservoir 2400. The one or more posts 2702 can additionally or alternatively facilitate alignment of the perforated tray 2402 within the reservoir 2400. For instance, the one or more posts 2702 can position the perforated tray 2402. It is to be appreciated that, in certain embodiments, the one or more posts 2702 can include multiple posts 2702 at multiple locations associated with the reservoir 2400 to facilitate stabilization of the perforated tray 2402. In an aspect, a post 2702 can align with and/or fit within a mounting hole from the set of mounting holes 2408. In another aspect, the one or more posts 2702 can enable the perforated tray 2402 to be placed at a variety of angles and/or heights relative to the reservoir 2400. A size and/or a shape of the one or more posts 2702 can correspond to a size and/or a shape of a mounting hole from the set of mounting holes 2408. In another embodiment, a pivot housing 2404 such as, for example, the pivot housing 2404*d* can include a set of posts 2704. For instance, the set of posts 2704 can be a set of mounts on a surface of the pivot housing 2404*d* (e.g., an underside surface of the pivot housing 2404*d* opposite to another surface of the pivot housing 2404*d* that comprises the modular peg 2406*g* and the modular peg 2406*h*) to enable the pivot housing 2404*d* to be mounted to a portion of the set of mounting holes 2408. The set of posts 2704 can align with and/or fit within at least a portion of the set of mounting holes 2408. For instance, the set of posts 2704 can facilitate alignment of the pivot housing 2404*d* with respect to the perforated tray 2402, where the set of mounting holes 2408 of the perforated tray 2402 accommodates the set of posts 2704. In one example, a particular number of posts from the set of posts 2704 can fit within a corresponding number of mounting holes from the set of mounting holes 2408. In an aspect, the set of posts 2704 can align with and/or fit within at least a portion of the set of mounting holes 2408. In another aspect, the set of posts 2704 can enable the pivot housing 2404*d* to be placed at a variety of positions relative to the perforated tray 2402. A size and/or a shape of the set of posts 2704 can correspond to a size and/or a shape of the set of mounting holes 2408. In an embodiment, the pivot housing 2404*d* can comprise a base portion that comprises the set of posts 2704. The set of posts 2704 can be a support mount adapted to be removably connected to the perforated tray 2402. In certain embodiments, the set of posts 2704 can be inserted into a peg structure 2706. For instance, a first surface of the perforated tray 2402 can be associated with the pivot housing 2404*d* and a second surface of the perforated tray 2402 can be associated with the peg structure 2706. The peg structure 2706 can facilitate alignment and/or placement of the pivot housing 2404*d* with respect to the perforated tray 2402. The peg structure 2706 can also assist in locking the pivot housing 2404*d* in a secure manner. This can be particularly beneficial when various items are placed on corresponding modular pegs 2406*a-h*. In an aspect, the peg structure 2706 can include one or more mating recesses 2706*a* disposed within a peg structure 2706. The pivot housing 2404*d* can also comprise a peg portion that can comprise an axle rotatably connected to the base portion. The modular peg 2406*g* and the modular peg 2406*h* can extend from the axle and can be adapted to hold an article to be, for example, drip dried. The modular peg 2406*g* and the modular peg 2406*h* can also be rotatable via the axle between a first upright open position and a second compacted storage position (e.g., as shown in FIG. 3). In another embodiment, the perforated tray 2402 can enable liquid to pass through to the reservoir 2400 via a first mounting hole 2408 of the perforated tray 2402. Furthermore, the pivot housing 2404 can comprise one or more modular pegs 2406 and can be attached to the perforated tray via at least a second mounting hole 2408 of the perforated tray 2402. Moreover, a post 2702 can align the perforated tray 2402 via a third mounting hole 2408 of the perforated tray 2402.

Figure 28:
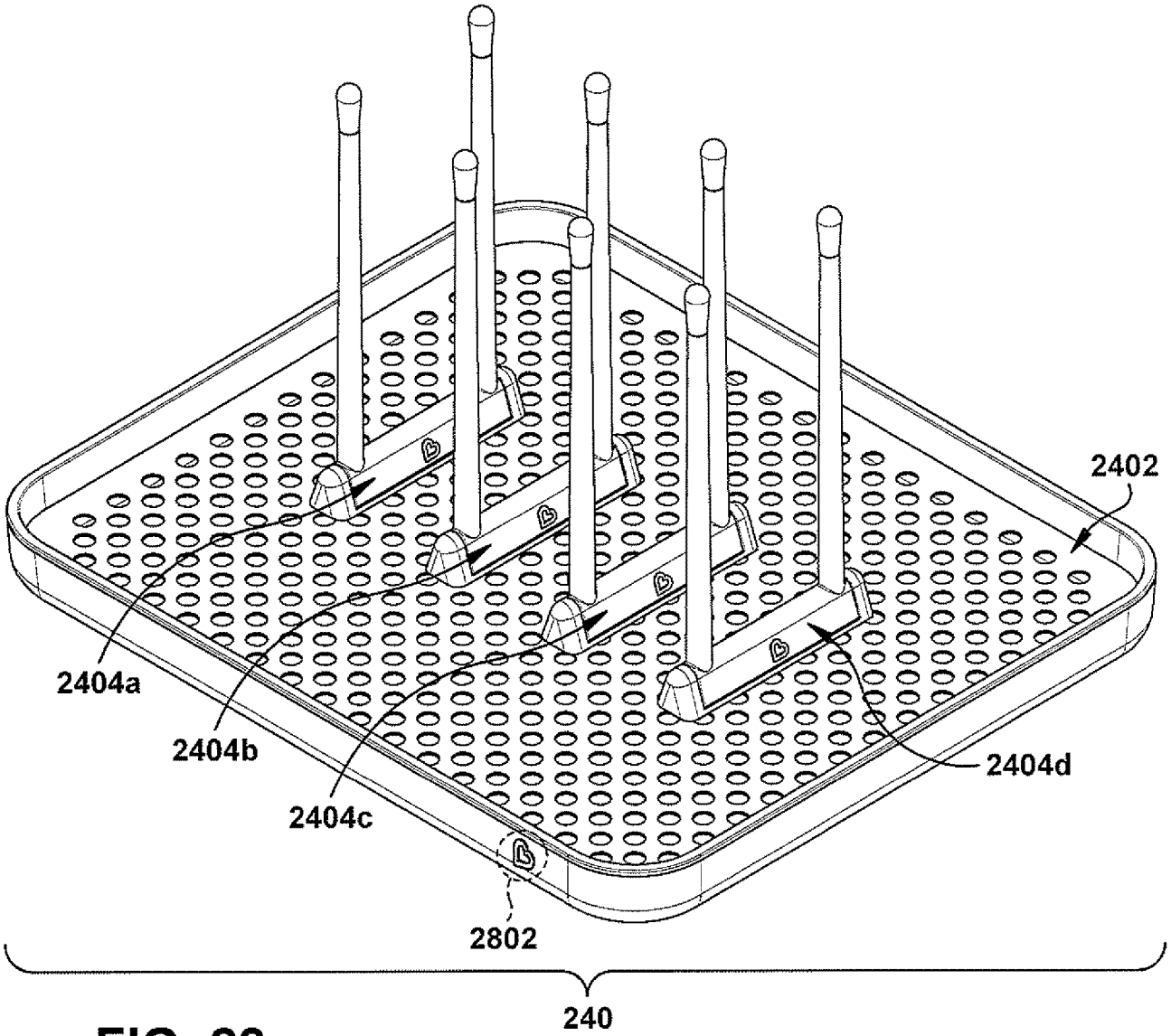
FIG. 28 illustrates yet another example schematic of a perspective view of a bottle rack in accordance with one or more embodiments described herein.

Referring now to FIG. 28, illustrated is an example perspective view of the bottle rack 240 in accordance with one or more embodiments described herein. In FIG. 28, the pivot housing 2404*a* can be associated with a first orientation with respect to the perforated tray 2402, the pivot housing 2404*b* can be associated with a second orientation with respect to the perforated tray 2402, the pivot housing 2404*c* can be associated with a third orientation with respect to the perforated tray 2402, and the pivot housing 2404*d* can be associated with a fourth orientation with respect to the perforated tray 2402. In an aspect, the first orientation associated with the pivot housing 2404*a*, the second orientation associated with the pivot housing 2404*b*, the third orientation associated with the pivot housing 2404*c* and/or the fourth orientation associated with the pivot housing 2404*d* can be modified to a different orientation. For instance, the first orientation associated with the pivot housing 2404*a*, the second orientation associated with the pivot housing 2404*b*, the third orientation associated with the pivot housing 2404*c* and/or the fourth orientation associated with the pivot housing 2404*d* can be modified to a different orientation as shown in, for example, FIG. 24. In a non-limiting example, the reservoir 2400 can include a marking 2802 that can be considered a front side of the bottle rack 240 for illustrative purposes. The marking 2802 can be associated with a wall (e.g., a side surface) of the reservoir 2400. As illustrated in FIG. 28, the pivot housings 2404*a-d* can be oriented in a perpendicular orientation with respect to the marking 2802. Furthermore, the pivot housings 2404*a-d* can be oriented parallel to each other. For instance, the pivot housing 2404*a* can be oriented parallel to the pivot housing 2404*b*, the pivot housing 2404*c* and/or the pivot housing 2404*d*.

Figure 29:
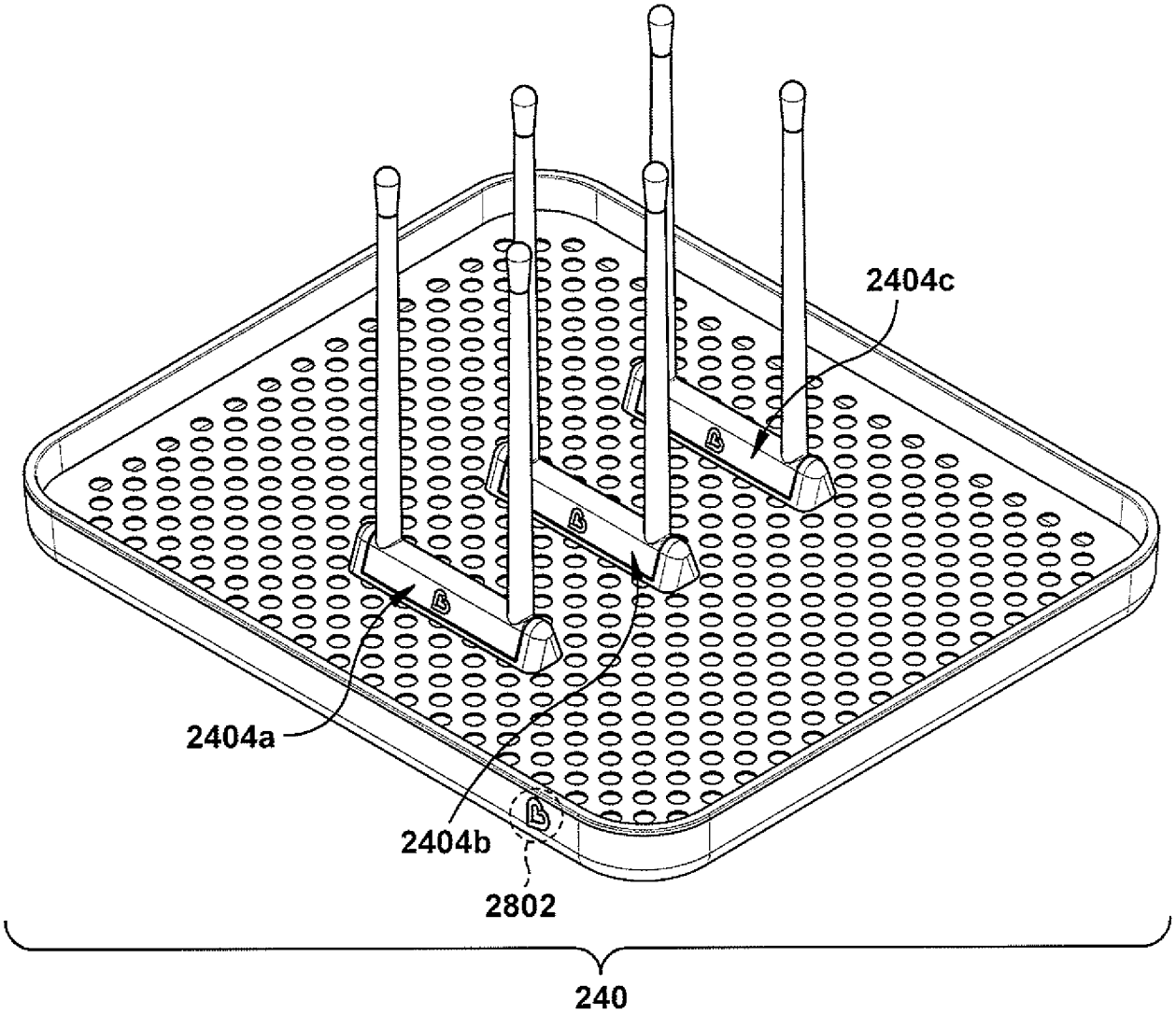
FIG. 29 illustrates yet another example schematic of a perspective view of a bottle rack comprising modular pegs in a parallel orientation in accordance with one or more embodiments described herein.

Referring now to FIG. 29, illustrated is an example perspective view of the bottle rack 240 in accordance with one or more embodiments described herein. In FIG. 29, the pivot housing 2404*a* can be associated with a fifth orientation with respect to the perforated tray 2402 that is different than the first orientation shown in FIG. 28, a pivot housing 2404*b* can be associated with a sixth orientation with respect to the perforated tray 2402 that is different than the second orientation shown in FIG. 28, and the pivot housing 2404*c* can be associated with a seventh orientation with respect to the perforated tray 2402 that is different than the third orientation shown in FIG. 28. The pivot housing 2404*d* can be removed from the perforated tray 2402, for example, in FIG. 29. In a non-limiting example, the reservoir 2400 can include the marking 2802 that can be considered a front side of the bottle rack 240 for illustrative purposes. As illustrated in FIG. 29, the pivot housings 2404*a-c* can be oriented in a parallel orientation with respect to the marking 2802. Furthermore, the pivot housings 2404*a-c* can be oriented parallel to each other. As such, the pivot housings 2404*a-d* and/or one or more modular pegs 2406 associated with the pivot housings 2404*a-d* can be moveable and/or reoriented with respect to the perforated tray 2402 to accommodate one or more articles. In certain embodiments, a pivot housing 2404 can be aligned diagonally with respect to a side of the reservoir 2400.

Figure 30:
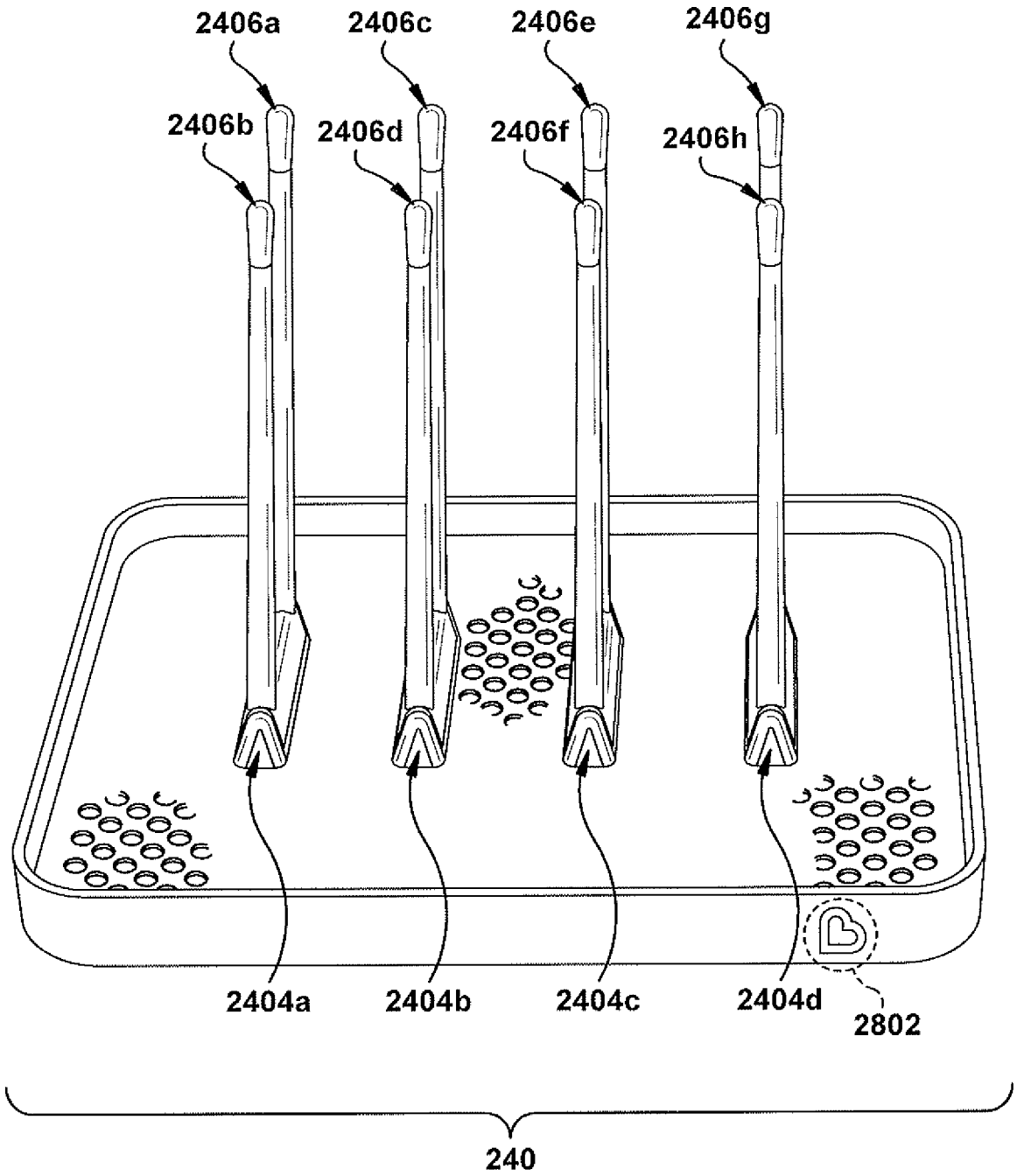
FIG. 30 illustrates yet another example schematic of a perspective view of a bottle rack comprising modular pegs in a perpendicular orientation in accordance with one or more embodiments described herein.

Referring now to FIG. 30, illustrated is an example perspective view of the bottle rack 240 in accordance with one or more embodiments described herein. In FIG. 30, the modular pegs 2406*a-h* of the pivot housings 2404*a-d* can comprise a corresponding height. However, in certain embodiments, one or more modular pegs from the modular pegs 2406*a-h* can comprises a different height than one or more other modular pegs from the modular pegs 2406*a-h*. For instance, in a non-limiting example, the modular peg 2406*a* and the modular peg 2406*b* associated with the pivot housing 2404*a* can comprise a different height than the modular peg 2406*c* and the modular peg 2406*d* associated with the pivot housing 2404*b*.

Figure 31:
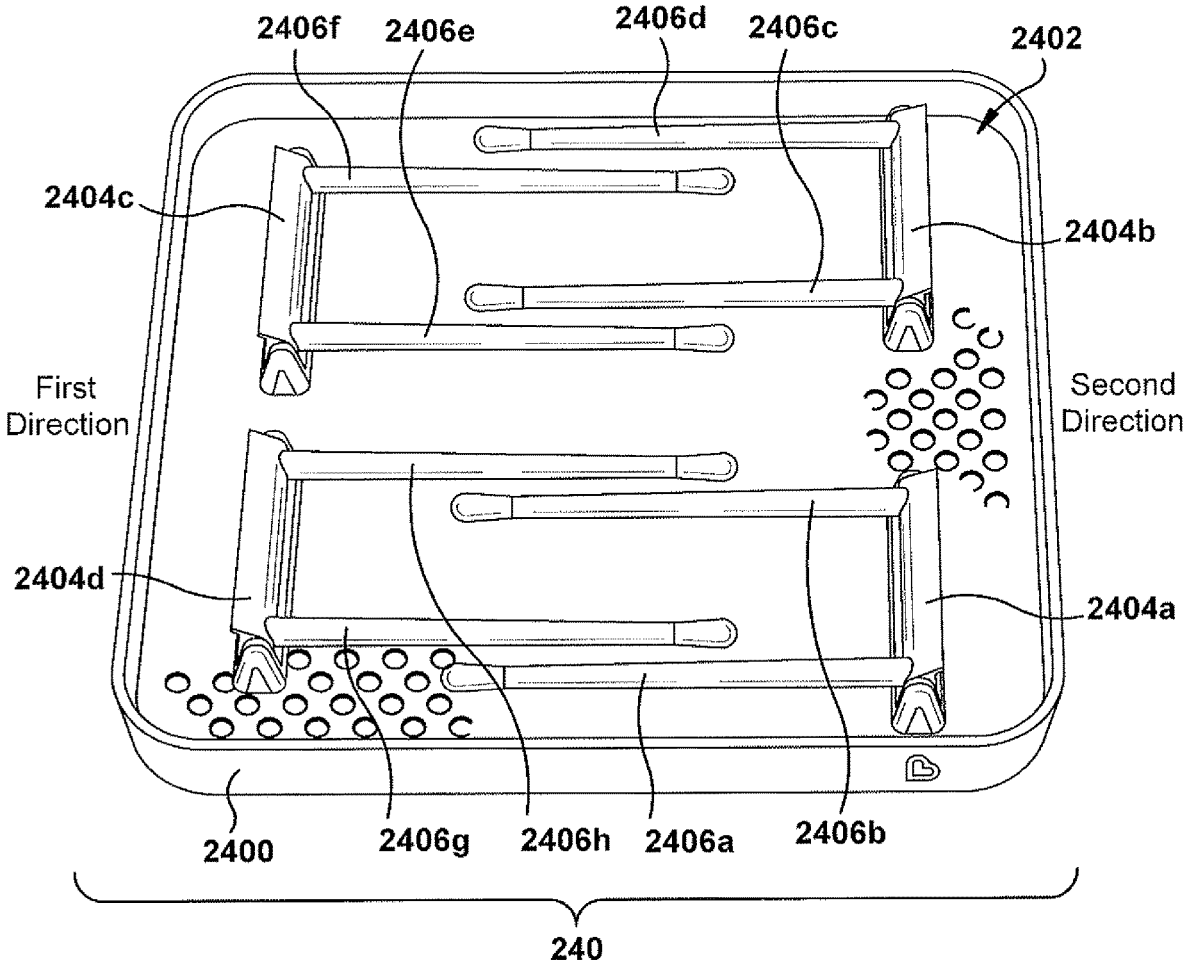
FIG. 31 illustrates yet another example schematic of a perspective view of a bottle rack comprising modular pegs in a compacted position in accordance with one or more embodiments described herein.

Referring now to FIG. 31, illustrated is an example perspective view of the bottle rack 240 in accordance with one or more embodiments described herein. In FIG. 31, the pivot housings 2404*a-d* can be rotated down to an orientation approximately parallel to a surface of the perforated tray 2402 (e.g., to enable modular pegs 2406*a-h* associated with the pivot housings 2404*a-d* to be in a semi-compacted position). In an aspect, the pivot housing 2404*a* can be rotated to enable modular pegs 2406*a-b* of the pivot housing 2404*a* to be oriented toward a first direction, the pivot housing 2404*b* can be rotated to enable modular pegs 2406*c-d* of the pivot housing 2404*b* to be oriented toward the first direction, the pivot housing 2404*c* can be rotated to enable modular pegs 2406*e-f* of the pivot housing 2404*c* to be oriented toward a second direction, and the pivot housing 2404*d* can be rotated to enable modular pegs 2406*g-h* of the pivot housing 2404*d* to be oriented toward the second direction. To facilitate the aforementioned orientations and enable the pegs to lay flush with each other, alignment of the pivot housing 2404*a* with respect to the pivot housing 2404*d* can be offset by a first defined amount, and alignment of the pivot housing 2404*b* with respect to the pivot housing 2404*c* can be offset by a second defined amount.

Figure 32:
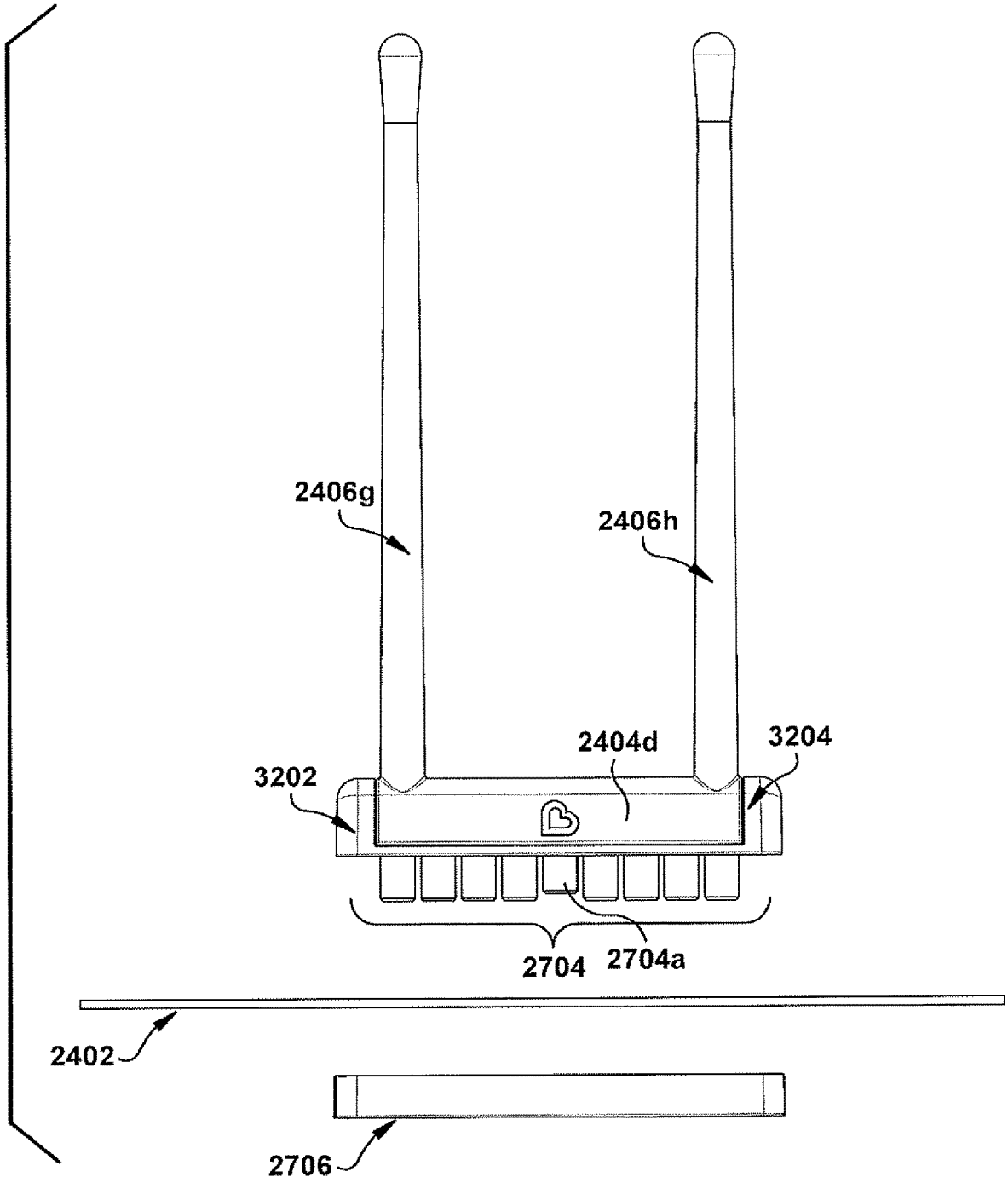
FIG. 32 illustrates an example schematic of a side view of a pivot housing in accordance with one or more embodiments described herein.

Referring now to FIG. 32, illustrated is an example side view of a pivot housing in accordance with one or more embodiments described herein. In FIG. 32, the pivot housing 2404*d* is shown with respect to the perforated tray 2402 and the peg structure 2706. As shown in FIG. 32, the pivot housing 2404*d* can include the set of posts 2704. Furthermore, the modular peg 2406*g* and the modular peg 2406*h* can extend from the pivot housing 2404*d*. In an embodiment, the pivot housing 2404*d* can include a first fixed end portion 3202 and a second fixed end portion 3204. A portion of the rotating axle of the pivot housing 2404*d* can extend into the first fixed end portion 3202 and the second fixed end portion 3204 such that the portion the rotating axle of the pivot housing 2404*d* can rotate within the first fixed end portion 3202 and the second fixed end portion 3204. In another embodiment, the pivot housing 2404*d* can be attachable and/or removable with respect to the perforated tray 2402 via the set of posts 2704. For instance, the set of posts 2704 can be configured to fit within the set of mounting holes 2408 associated with the perforated tray 2402. As shown in FIG. 32, posts from the set of posts 2704 can be of similar lengths or different lengths. Different length posts 2704*a* from the set of posts 2704 can be employed to ensure proper alignment with one or more mating recesses 2706*a* (shown in FIG. 27) disposed within a peg structure 2706.

Figure 33:
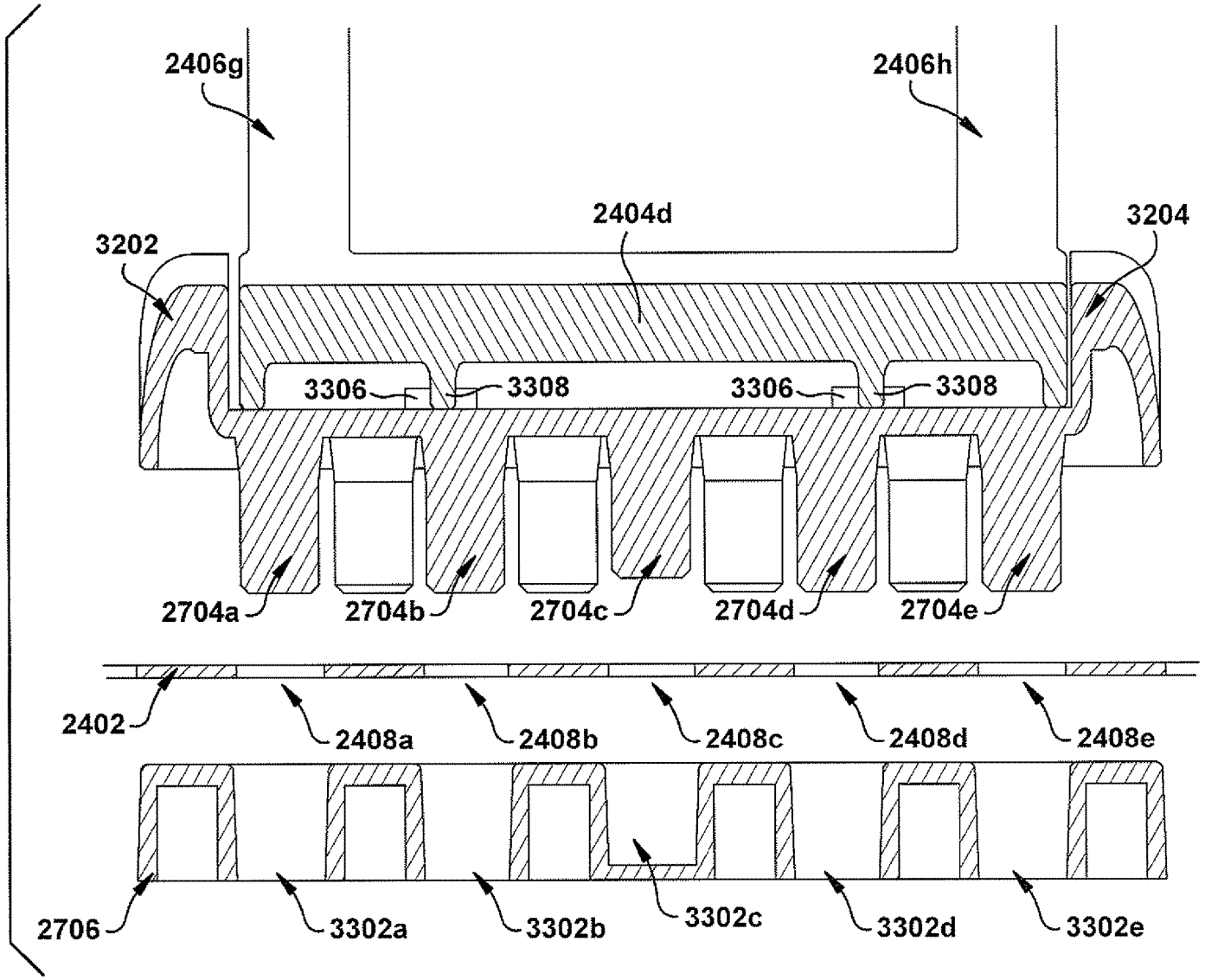
FIG. 33 illustrates another example schematic of a side view of a pivot housing in accordance with one or more embodiments described herein.

Referring now to FIG. 33, illustrated is an example side view of a pivot housing in accordance with one or more embodiments described herein. In FIG. 33, the pivot housing 2404*d* is shown with respect to the perforated tray 2402 and the peg structure 2706. As shown in FIG. 33, the pivot housing 2404*d* can include a set of posts 2704*a-e*. Furthermore, the modular peg 2406*g* and the modular peg 2406*h* can extend from the pivot housing 2404*d*. In an embodiment, the pivot housing 2404*d* can include the first fixed end portion 3202 and the second fixed end portion 3204. A portion of the rotating axle of the pivot housing 2404*d* can extend into the first fixed end portion 3202 and the second fixed end portion 3204 such that the portion the rotating axle of the pivot housing 2404*d* can rotate within the first fixed end portion 3202 and the second fixed end portion 3204. In another embodiment, the pivot housing 2404*d* can be attachable and/or removable with respect to the perforated tray 2402 via the set of posts 2704*a-e*. For instance, the set of posts 2704*a-e* can be configured to fit within a corresponding set of mounting holes 2408*a-e* associated with the perforated tray 2402. Additionally, the set of posts 2704*a-e* can be configured to fit within a corresponding set of openings 3302*a-e* associated with the peg structure 2706. In an aspect, the pivot housing 2404*d* can be associated with a first surface of the perforated tray 2402 and the peg structure 2706 can be associated with a second surface of the perforated tray 2402. For instance, the perforated tray 2402 can be implemented between the pivot housing 2404*d* and the peg structure 2706. In certain embodiments, the pivot housing 2404*d* can include a snap lock configuration comprising a protrusion 3306 that locks into a recess 3308.

Figure 34:
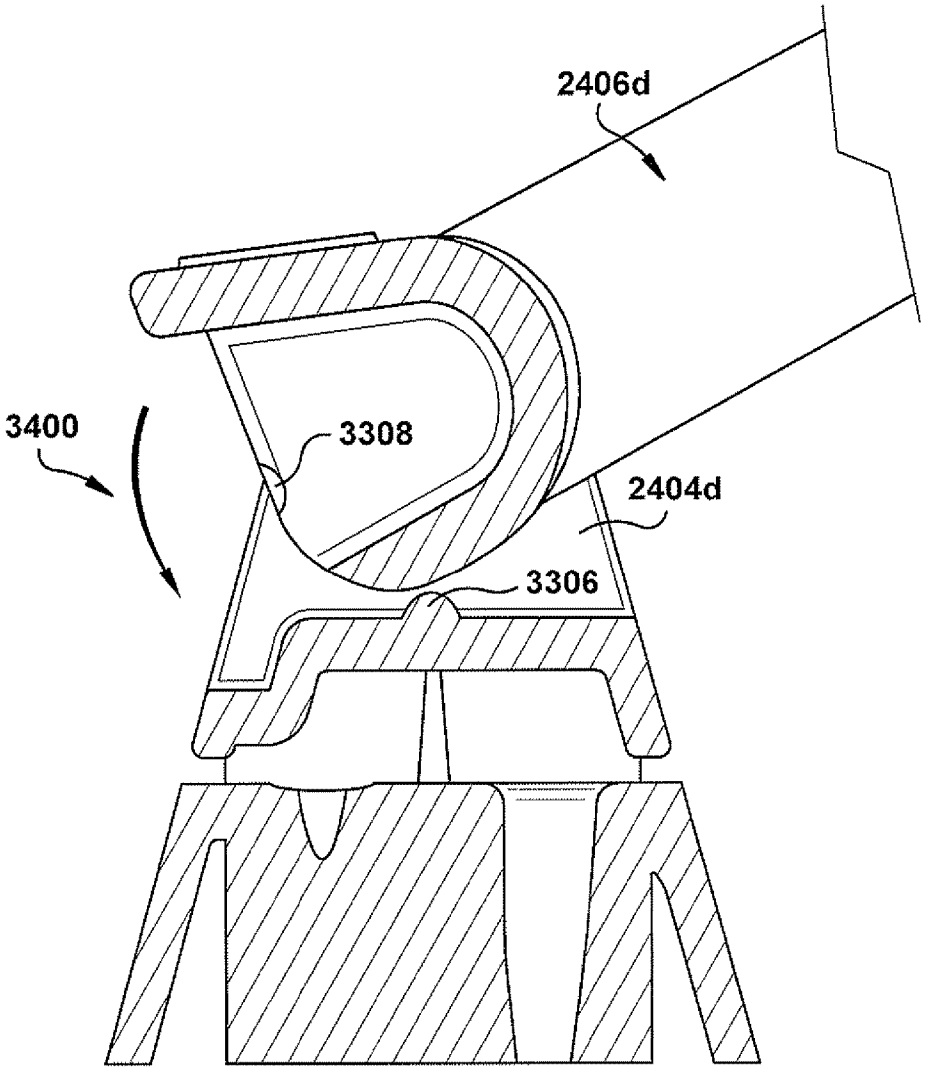
FIG. 34 illustrates an example section view of a pivot housing in accordance with one or more embodiments described herein.

Referring now to FIG. 34, illustrated is an example section view of a pivot housing (e.g., pivot housing 2404*d*) in accordance with one or more embodiments described herein. In FIG. 34, a snap lock configuration 3400 can employ the protrusion 3306 and the recess 3308. For instance, the protrusion 3306 can lock into the recess 3308 to, for example, enable the modular peg 2406*h* to swing and lock into a fully upright position.

Figure 35:
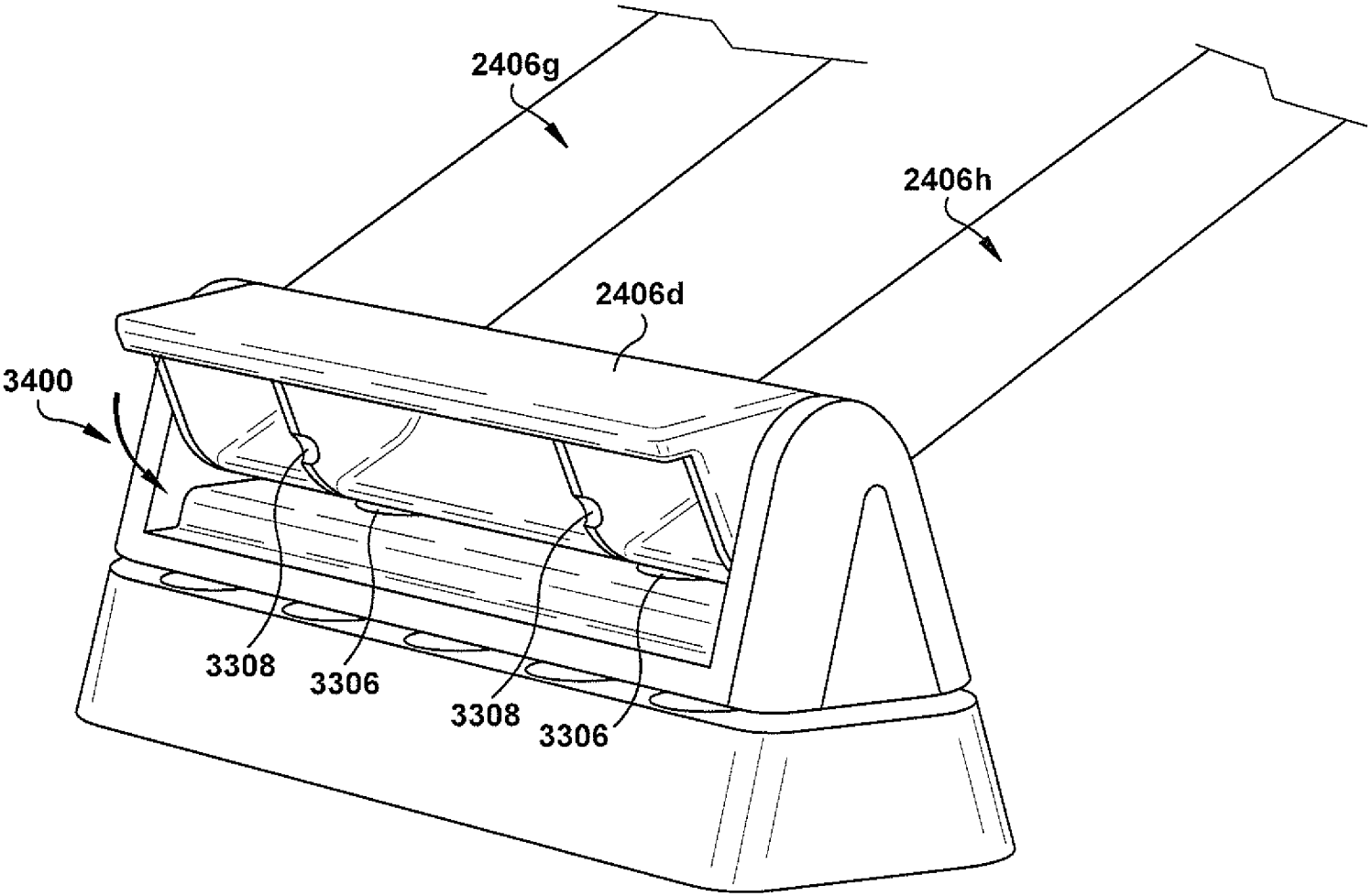
FIG. 35 illustrates an example perspective view of a pivot housing in accordance with one or more embodiments described herein.

Referring now to FIG. 35, illustrated is an example perspective view of a pivot housing (e.g., pivot housing 2404*d*) in accordance with one or more embodiments described herein. In FIG. 35, the snap lock configuration 3400 can employ multiple protrusions 3306 and multiple recesses 3308. For instance, the protrusions 3306 can lock into corresponding recesses 3308 to, for example, enable the modular peg 2406*g* and the modular peg 2406*h* to swing and lock into a fully upright position.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the subject matter has been described herein in connection with various embodiments and corresponding FIGS., where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Further, the term "include" is intended to be employed as an open or inclusive term, rather than a closed or exclusive term. The term "include" can be substituted with the tem' "comprising" and is to be treated with similar scope, unless otherwise explicitly used otherwise. As an example, "a basket of fruit including an apple" is to be treated with the same breadth of scope as, "a basket of fruit comprising an apple."

What has been described above includes examples of systems and methods illustrative of the disclosed subject matter. It is, of course, not possible to describe every combination of components or methods herein. One of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A portable apparatus, comprising:

a reservoir for retention of liquid;

a perforated tray extending planar over the reservoir to enable the liquid to pass through to the reservoir; and a first pivot housing member comprising a mount on a surface of the first pivot housing member, the mount having at least one post, the pivot housing member further comprising a first peg to hold an article, wherein the first pivot housing member comprises an axle within the first pivot housing member, and wherein the first peg is rotatable via the axle;

wherein the first pivot housing member is modular and adapted to be removably connected by the at least one post extending into at least one perforation disposed substantially orthogonal to the extending plane of the perforated tray in a plurality of positions.

2. The apparatus of claim 1, wherein the reservoir comprises an elevating post to position the perforated tray.

3. The apparatus of claim 1, wherein the perforated tray comprises a mounting hole to accommodate the mount.

4. The apparatus of claim 1, further comprising: a second pivot housing member, wherein the first pivot housing member and the second pivot housing member are parallel.

5. The apparatus of claim 4, wherein the second pivot housing member comprises a second peg to hold another article.

6. The apparatus of claim 5, wherein the first peg comprises a first height and the second peg comprises a second height, and wherein the first height and the second height are different heights.

7. A portable apparatus, comprising:

a reservoir that retains a liquid;

a perforated tray extending planar over the reservoir that allows the liquid to pass through to the reservoir; and a first modular pivot housing member, comprising:

a base comprising at least one support mount having at least one post adapted to be removably connected to the perforated tray; wherein the first pivot housing member is adapted to be removably connected orthogonally into the extending plane of the perforated tray in a plurality of positions and a peg structure, comprising:

an axle rotatably connected to the base; and a first peg extending from the axle and adapted to hold an item to be drip dried, wherein the first peg is rotatable via the axle between a first upright open position and a second compacted storage position.

8. The apparatus of claim 7, wherein the reservoir comprises an elevating post to position the perforated tray.

9. The apparatus of claim 7, wherein the perforated tray comprises a mounting hole to accommodate the at least one support mount.

10. The apparatus of claim 7, further comprising: a second modular pivot housing member, wherein the first modular pivot housing member and the second modular pivot housing member are parallel.

11. The apparatus of claim 10, wherein the second modular pivot housing member comprises a second peg that holds another item.

12. The apparatus of claim 11, wherein the first peg comprises a first height and the second peg comprises a second height, and wherein the first height and the second height are different heights.

* * * * *